US006796877B1

(12) United States Patent
Bingham et al.

(10) Patent No.: US 6,796,877 B1
(45) Date of Patent: Sep. 28, 2004

(54) ABRADING MACHINE

(75) Inventors: Richard Bingham, Cambridge (GB); David Charles Riley, Nottingham (GB)

(73) Assignee: University College London, London (GB)

( * ) Notice: Subject to any disclaimer, the term of this patent is extended or adjusted under 35 U.S.C. 154(b) by 0 days.

(21) Appl. No.: 09/857,291

(22) PCT Filed: Dec. 1, 1999

(86) PCT No.: PCT/GB99/04014

§ 371 (c)(1),
(2), (4) Date: Aug. 28, 2001

(87) PCT Pub. No.: WO00/32353

PCT Pub. Date: Jun. 8, 2000

(30) Foreign Application Priority Data

Dec. 1, 1998 (GB) ..... 9826369
Dec. 1, 1998 (GB) ..... 9826371
Dec. 1, 1998 (GB) ..... 9826372

(51) Int. Cl.[7] ..... B24B 49/00
(52) U.S. Cl. ..... 451/5; 451/47; 451/56; 451/147; 451/161; 451/900
(58) Field of Search ..... 51/165.71, 5 D; 451/5, 8, 56, 147, 161, 285–290, 900

(56) References Cited

U.S. PATENT DOCUMENTS 4,523,409 A * 6/1985 De Fazio ..... 451/5
4,617,764 A * 10/1986 Reibakh ..... 451/5
5,482,496 A * 1/1996 Lanzer ..... 451/5
5,516,327 A * 5/1996 Kawasaki ..... 451/60
6,165,057 A * 12/2000 Gill, Jr. ..... 451/287
6,217,409 B1 * 4/2001 Stadtfeld et al. ..... 451/5
6,622,906 B1 * 9/2003 Kushibe ..... 228/212

* cited by examiner

*Primary Examiner*—Joseph J. Hail, III
*Assistant Examiner*—Anthony Ojini
(74) *Attorney, Agent, or Firm*—Finnegan, Henderson, Farabow, Garrett & Dunner, L.L.P.

(57) ABSTRACT

A machine for abrading or polishing a workpiece comprises a holding surface holding the workpiece, a head member arranged along a rotation axis to rotate about the rotation axis, a working member having a surface for abrading or polishing the workpiece arranged on the head member on die rotational axis for rotation about the rotation axis with the head member, a first driving arrangement for driving a head member and the working member mounted thereon to rotate about the rotation axis, a head mounting arrangement for mounting the head member, a second driving arrangement for driving the head mounting arrangement to incline the rotation axis of the head member relative to a precession axis intersecting the rotation axis, and for moving the head member to inclined positions with the rotation axis processed about the precession axis, and a third driving arrangement for relatively moving the head mounting arrangement across the holding surface.

29 Claims, 27 Drawing Sheets

ABRADING MACHINE

Figure 1:
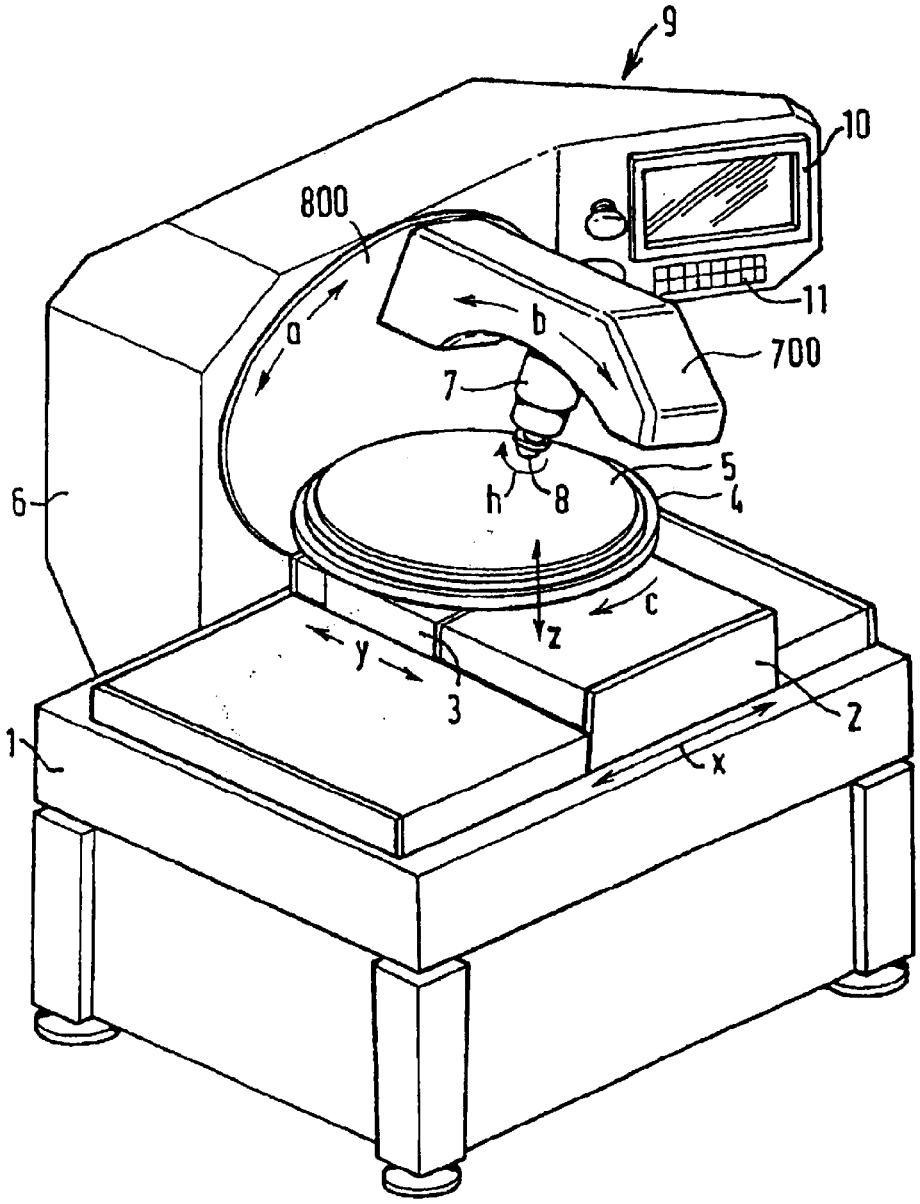

The present invention generally relates to a polishing machine and method for abrading or polishing a workpiece.

The present invention also relates to a tool and an abrasive cup for fitment to a tool for the use in abrading or polishing a workpiece.

The abrading or polishing of the surface of a workpiece is a technique which has applications in many different fields including the production of semi-conductor devices and optical components. The requirement is to provide a surface which has a particular surface contour and a particular surface finish i.e. smoothness. In the field of optical polishing there are two different techniques, one technique uses a tool for polishing which has a size comparable with that of the size of the workpiece. The limitation of this technique is that the tool is designed for a specific workpiece and this cannot be used universally. In order to reduce this limitation, an active lap has been developed as disclosed in GB 2163076 wherein the pressure distribution over the workpiece can be varied in order to differentially abrade or polish.

In the second technique the tool is substantially smaller than the workpiece and is moved across the workpiece in order to carry out the abrading or polishing process. Such a technique is described in U.S. Pat. No. 4,128,968. In this technique two pads are maintained in contact with the surface of the workpiece and are relatively rotated and moved in a spiralling path around the surface of the workpiece. Another such technique disclosed in WO97/00155 uses a tool which has a flexible working surface so that the effective area of contact with the workpiece can be controlled. This provides the benefit that the area being polished at any one time during the polishing cycle can be controlled.

In these prior art techniques, the tool is usually spun around an axis normal to the workpiece. A limitation to this technique is that on the axis the relative movement is zero and thus the removal or ablation rate is zero. Thus the use of such a tool having such a removal prof lee Bakes it difficult to achieve a desired target profile using an automatic polishing or abrading technique.

In the technique of WO97/00155, the angle of attack of the tool to the workpiece is variable using an arrangement which provides a "virtual pivot" on the surface of the workpiece. This has the benefit of ensuring when the tool is tilted there is no lateral or vertical movement of the centre of the tool in contact with the workpiece. However, the disclosed mechanical arrangement is complex and large.

U.S. Pat. No. 4,958,463 discloses a different technique in which a resilient working member is rotated about its axis parallel to the surface of the workpiece to provide relative lateral motion between the working member and the surface of the workpiece. The working member is held to rotate in a mounting member. The mounting member mounting the working member is also rotated perpendicularly to the surface of the workpiece. While this technique does not suffer from the lack of removal of material in the centre of the area of contact, it requires a complex arrangement involving the use of two motors to provide the two axes of rotation.

In accordance with a first aspect of the present invention there is provided a method and apparatus for abrading or polishing a workpiece. A workpiece is held on a holding surface of the and a head having a surface for abrading or polishing the workpiece is moved across the workpiece in a figuring pattern in order to polish or abrade the workpiece. In addition to the figuring movement of the head, the face of the head carrying out the abrading or polishing is arranged to move in a direction laterally on the surface of the workpiece by inclining and rotating the head. The direction of lateral movement of the face is rotated by moving the head to positions which are a precession of the inclined head about a precession axis normal to the workpiece surface.

Thus in accordance with this aspect of the present invention, instead of having a removal profile which is zero at the centre of the area of contact of the tool, it is possible to simply incline the head to use a face which is moved laterally relative to the workpiece, thus providing a non-axially symmetric removal profile at any one instance in time. An axially symmetric removal profile is however an advantage when deterministic automatic polishing is required. In order to make the average removal profile over a period of time symmetric, the head is moved to positions precessed relative to the surface of the workpiece such that the direction of lateral relative movement of the face of the tool rotates. Thus any pattern generated in the surface of the workpiece by the lateral movement at an instance in time will be generated at a number of rotational angles thus reducing the defects and producing an axially symmetric profile.

Another advantage of the technique of this aspect of the invention is that the movement of the abrading face is self-wetting. The cooling/lubricating fluid or slurry used between the abrading surface and the workpiece will be carried under the tool by the polishing action. In contrast, in the prior art techniques which use axial rotation of a tool normal to the surface of the workpiece, the cooling/lubricating fluid will tend to move to the circumference of the polishing area by centrifugal force.

This aspect of the present invention is applicable to any form of inclined rotating tool which can provide relative lateral movement between the workpiece and the abrading face and which can be precessed to rotate the direction of lateral movement e.g. an axially rotatable conical shaped tool.

In order to achieve averaging, preferably the precession takes place throughout at least 360 degrees. This can be achieved by incrementing the precession. Preferably such increments should be over more than one precession cycle. In one embodiment the increment in the precession is not an integer division of 360 degrees so that the direction of relative lateral motion is different for each cycle. In another embodiment the increments are symmetric about the 360° precession cycle.

In a preferred embodiment, the face comprises a compliant bulbous portion extending from the head. As the compliant portion is rotated about its inclined axis the bulbous portion forms an area of contact with the workpiece wherein there is relative lateral movement.

The abrading face can comprise a cloth or pitch on to which an abraded loaded slurry e.g. a diamond paste is placed. Alternatively, a bound abrasive can be used which is bound to the abrading face. When such a bound abrasive is used, only a cooling/lubricating fluid is required.

A second aspect of the present invention provides a polishing or abrading machine or method wherein a head carrying a face for abrading or polishing is held by a mechanical arrangement to allow for figuring of a workpiece. The mechanical arrangement includes a tilting mechanism arranged to tilt the head about a pivot to enable tilting relative to the workpiece. In this way not only can the head follow the contours of the workpiece but also it can be tilted to either follow the surface or be inclined at a required angle to the surface. Because the pivot is not on the workpiece when the head is tilted there is a displacement of the face of the head across, to or away from the workpiece. This is compensated for by either calculating or looking-up the required compensation values to control the mechanical arrangement to take up the displacements in the lateral and vertical directions.

This aspect of this present invention differs from the prior art disclosed in WO97/00155 in that a far simpler pivoting arrangement can be provided for example by use of an orthogonal arcuate track arrangement allowing tilting in any solid angle. In order to enable the use of a such a simple pivoting arrangement however, the displacement of the polishing face must be compensated for by a controller which determines the solid tilt angle and compensates the lateral and vertical displacements accordingly. Further, even if the virtual pivot is used as disclosed in WO97/00155, if a soft face is used e.g. a compliant material, it is necessary to compensate for the displacement of the compliant material as the head is pressed onto the workpiece.

Either the first aspect or the second aspect of the present invention can be implemented using a polishing apparatus under computer control. These aspects of the present invention can thus be embodied as a computer program and a carrier medium storing the computer program for controlling a processor to control the polishing apparatus. Since the computer program can be transmitted over a network such as the Internet, these aspects of the present invention can be embodied as a signal carrying the computer program for controlling the processor to control a polishing or abrading apparatus.

A third aspect of the present invention provides an improvement to the soft tool of WO97/00155. The soft tool is provided with an abrasive cup for releasable fitment to the soft tool wherein a sheet is preformed in the shape of the surface of the soft tool to be used for polishing and is sufficiently flexible to allow its deformation as a result of compression of the soft tool during abrading or polishing. The sheet is held at its periphery by a carrier member which is releasably mountable to a holder of the soft tool.

Since the sheet will become worn during the polishing or abrading process, it is removable from the tool. Since the surface of the tool to be used for polishing is compliant, the membrane must be flexible to conform to any compliance of the flexible tool Because of the compliance of the soft tool and the need for the sheet to flex to follow the compliance, it is preferred that means are provided to allow relative lateral movement between the sheet and the surface of the compliant tool. This is necessary in view of the different radii of curvature of the surface of the soft tool and of the sheet. Suitable means which can allow for some relative lateral movement comprises a lubricant or an unset adhesive. Use of an Unset adhesive provides the advantage that the sheet is adhered to the surface of the soft tool and thus benefits from the support provided thereby. In other words during the abrading or polishing operation some of the lateral force experienced by the sheet can be passed to the soft tool. If on the other hand a lubricant is used, the sheet must have sufficient torsional strength to be able to withstand the forces experienced during the abrading or polishing operation as the tool is dragged across the surface of the workpiece since the sheet is mechanically driven from its periphery A fourth aspect of the present invention provides a method and a machine for abrading or polishing a workpiece and which has a soft tool head comprising a fluid filled chamber which is detachable from a tool body without having to break the fluid seal. The tool body is a rotational body which extends along the rotational axis and has a pressure transmission means at one end thereof for transmitting pressure to the fluid chamber of the tool head. The tool head is releasably mounted on the tool body and comprises a head housing, a head fluid transmission means and resilient membrane forming the seal fluid chamber. The head fluid pressure transmission means is arranged to cooperate with the pressure transmission means of the tool body to transmit pressure to the fluid in the head of fluid chamber. The resilient membrane is held at its periphery by the head housing to extend in a curved manner therefrom for the application of pressure to the workpiece during abrading or polishing.

This aspect of the present invention provides a resilient working member, the resilience of which can be controlled by controlling the pressure of the fluid within it. The tool head benefiting from this advantage can also be readily interchanged when necessary due to wear or due to the need to change to different tool head sizes In one embodiment of the present invention, the tool body has a fluid chamber filled with fluid terminating at the pressure transmission means. This enables fluid pressure to be transmitted through the fluid body chamber to the head body chamber from a fluid pressure control arrangement provided separately into the rotatable tool. Because two separate fluid filled chambers are used in the tool head and the tool body, the tool head can be readily removed front the tool body without breaking the fluid seal.

In one embodiment the fluid pressure is transmitted from the body fluid chamber to the head fluid chamber via respective displacement devices mounted on the tool body and the tool head respectively. The respective displacement devices are coupled to one another to provide the transmission of pressure. This may be a direct physical coupling or a coupling via an intermediary e.g. via air.

A fifth aspect of the present invention provides a method and apparatus for controlling polishing or abrading of a workpiece. Data defining an influence function of the tool is used. The influence function defines the pattern of removal of material from the workpiece for a predetermined dwell time or speed of the tool. The desired profile is compared with the current profile of the surface to the workpiece and a difference between them is determined. Dwell times or tool speeds for predetermined positions on the surface of the workpiece are determined using numerical optimisation of the dwell times or tool speeds for the predetermined positions using the influence function to reduce a cost function.

The technique is preferably iterative wherein a cost function is repeatedly determined for various dwell times or tool speeds until a minimum cost function is found relating to the optimum dwell times or tool speeds to substantially achieve the desired profile.

Thus for this technique, predetermined positions are used for the application of the influence functions and the technique thus becomes simply the optimisation of a set of values to achieve a result.

There are many techniques which can be used for this type of optimisation. The technique can reduce the sum of the squares of the difference between the target removal profile and a predicted removal profile. A genetic algorithm can be used in order to determine candidate values for the dwell times or tool speeds. A cost function can be calculated for the dwell times or tool speeds to determine whether the proposed value is a candidate for keeping in the "gene" pool, or not.

In one embodiment, the desired profile comprises a desired radial profile for a circular workpiece and is thus only a two dimensional profile. This radial function applies equally to all radii of the surface of the workpiece. The influence function is also defined as a two dimensional function and the predetermined positions comprise radial positions across the surface of the workpiece. Thus the numerical optimisation technique only comprises the optimisation of a sequence of numbers defining the dwell times for radial positions across the surface of the workpiece, having regard to the radial error in the profile achieved.

In a more complex embodiment of the present invention, the desired profile is defined across an area of the surface of the workpiece and thus comprises a three dimensional profile. The influence function is thus also necessarily defined as a three dimensional function or at least a projection of a two dimensional radial function into three dimensions. The predetermined positions at which the influence function is to be applied comprise a two dimensional array of positions across the surface of the workpiece. Thus in this embodiment of the present invention, the numerical analysis technique must determine dwell times or tool speeds for the two dimensional array of positions across the surface of the workpiece. In order to reduce computational time, it is possible to use a coarse grid of array positions in order to determine the dwell times or tool speeds for the positions. Dwell times or tool speeds for intermediate positions can then be determined by interpolation where necessary. For example, when the figuring pattern to be traced out by the head comprises a circular pattern, the interpolation takes place in order to define dwell times or tool speeds along arcs to be traced by the head. Where the figuring pattern is to comprise a rastering scan, the interpolation is carried out for the linear rastering pattern in order to determine dwell times or tool speeds along the path to be taken by the head during the figuring operation.

Figure 2:
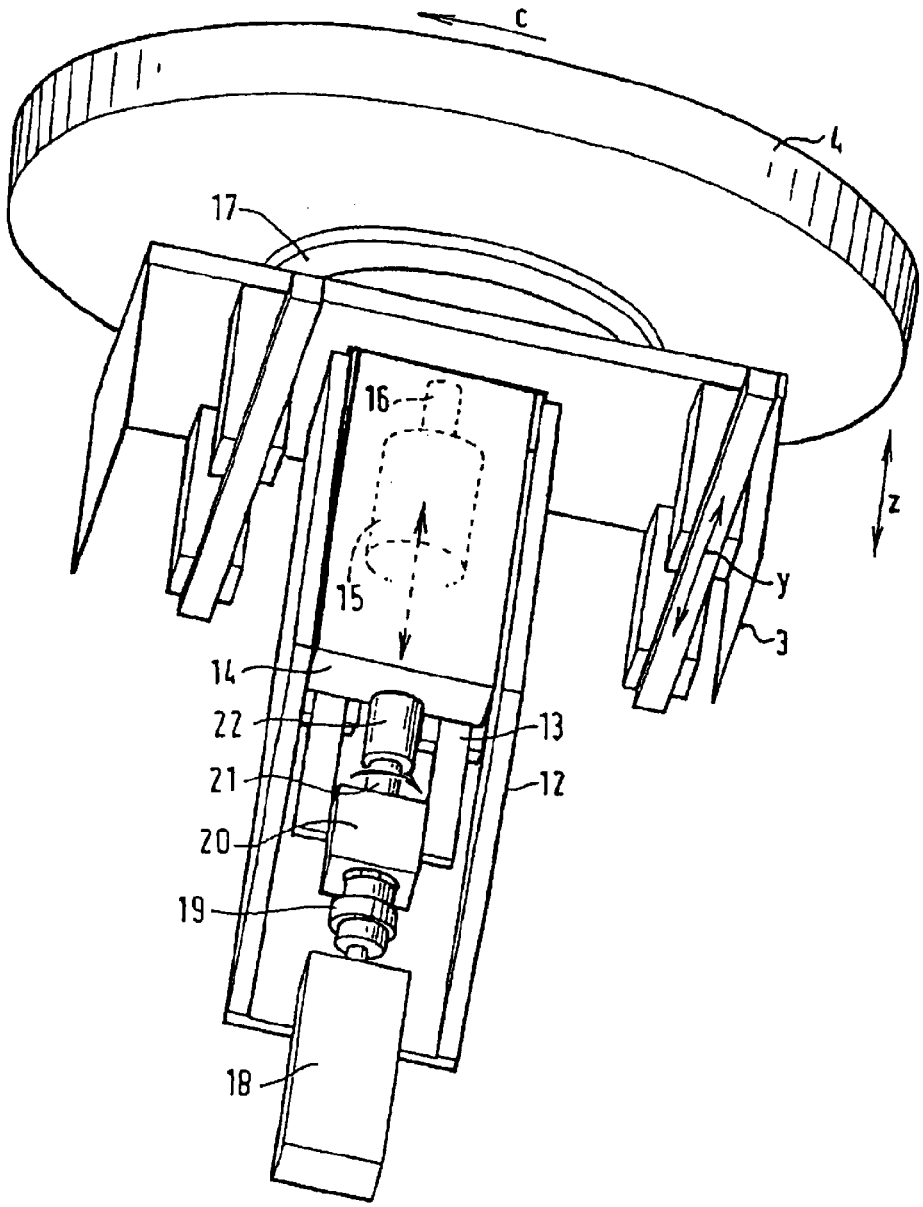
Figure 3:
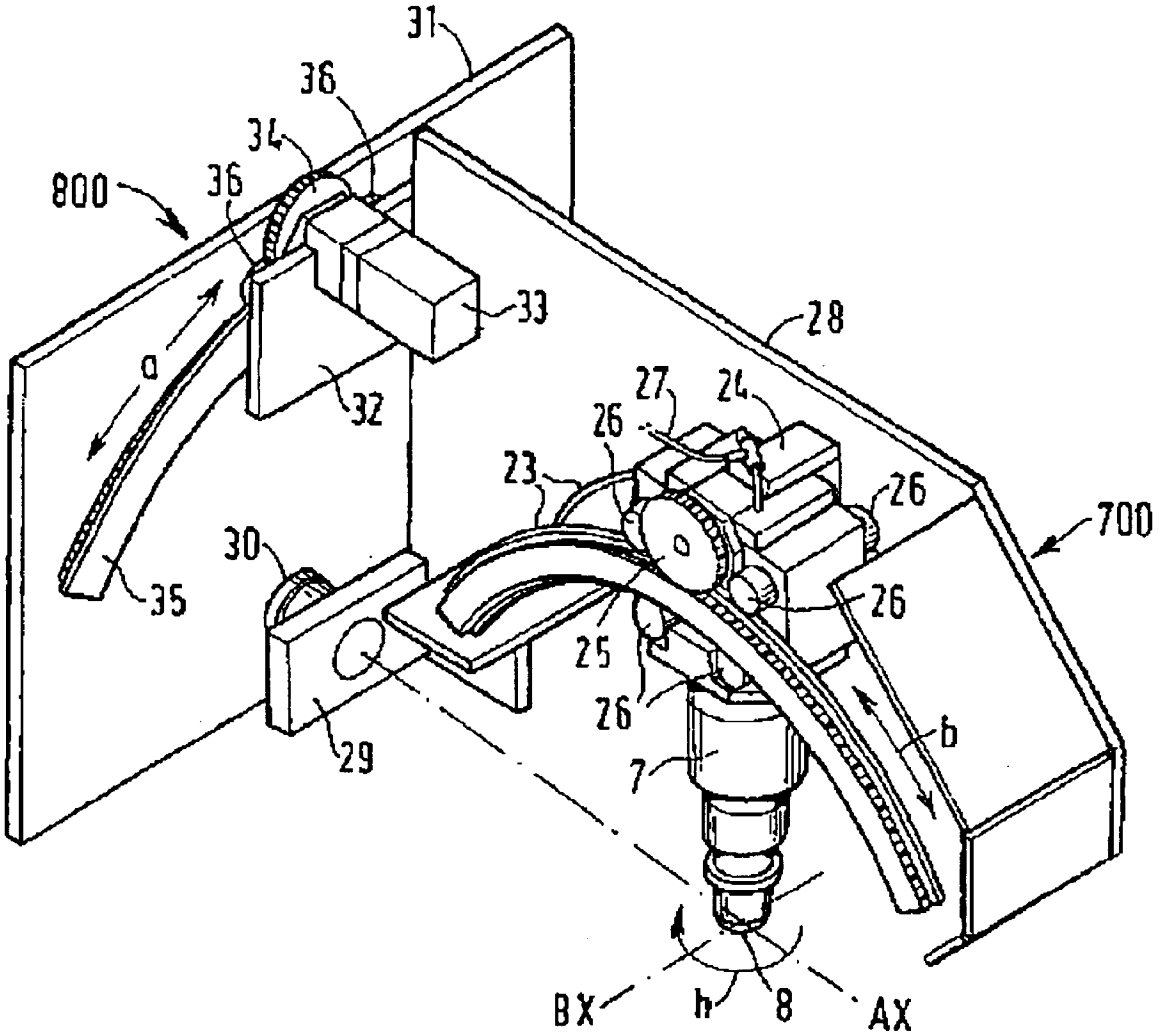
Figure 4:
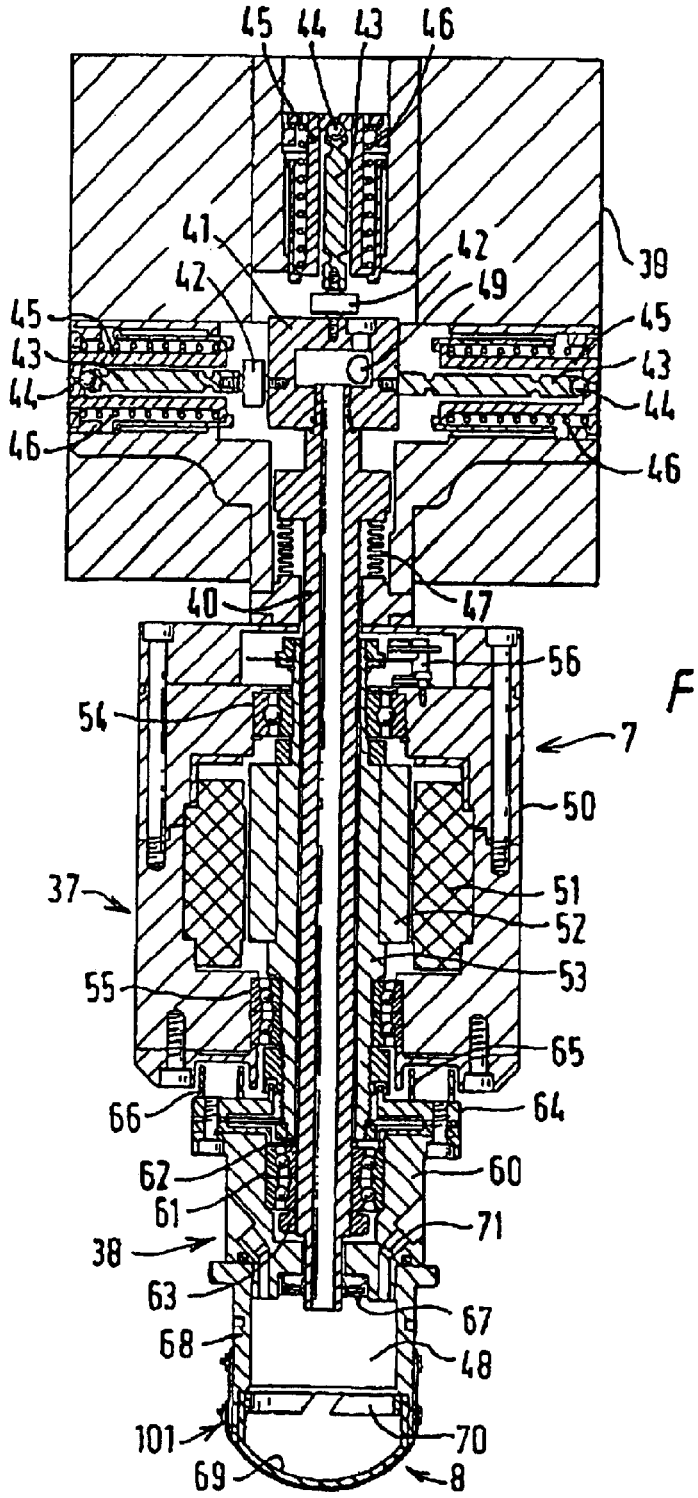
Figure 5:
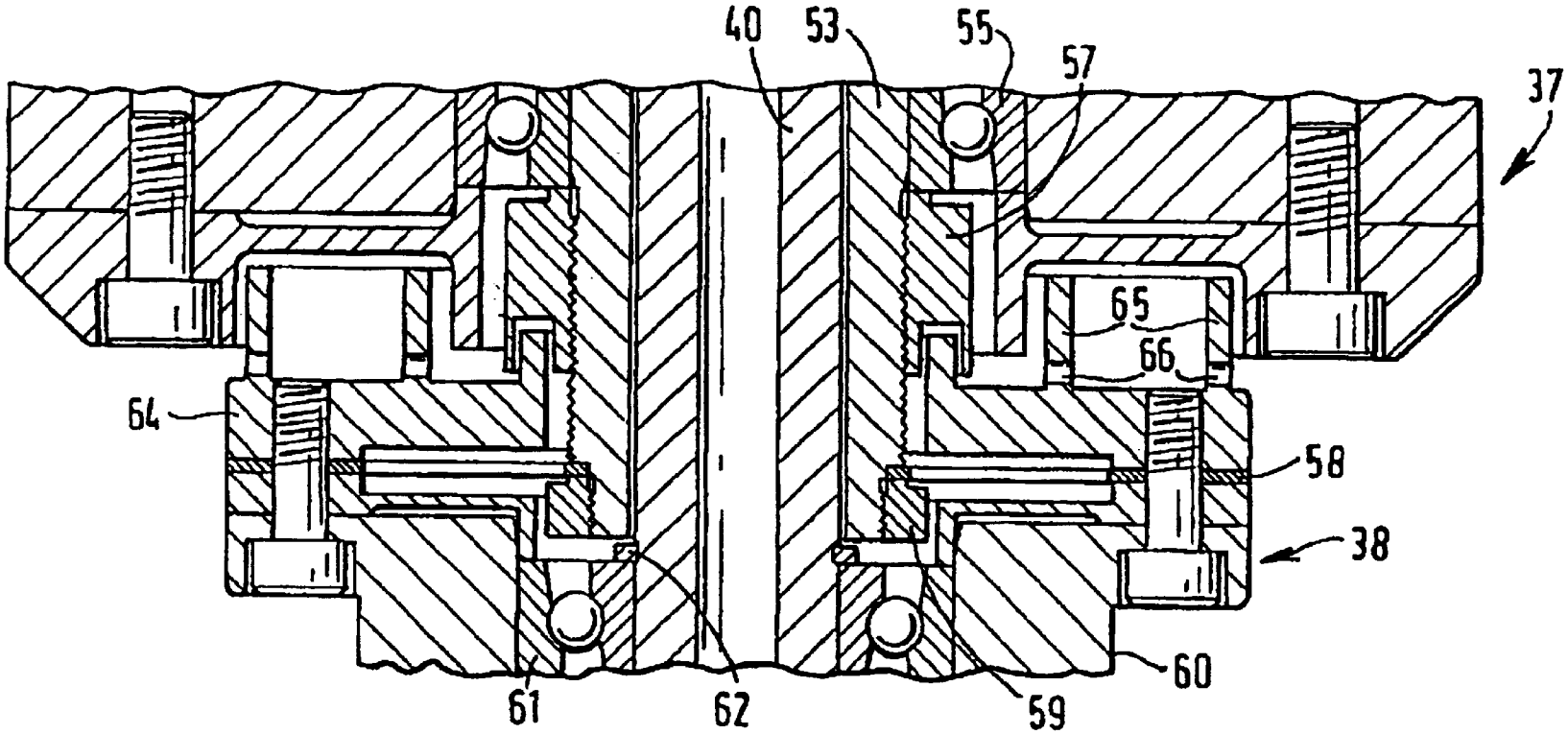
Figure 6:
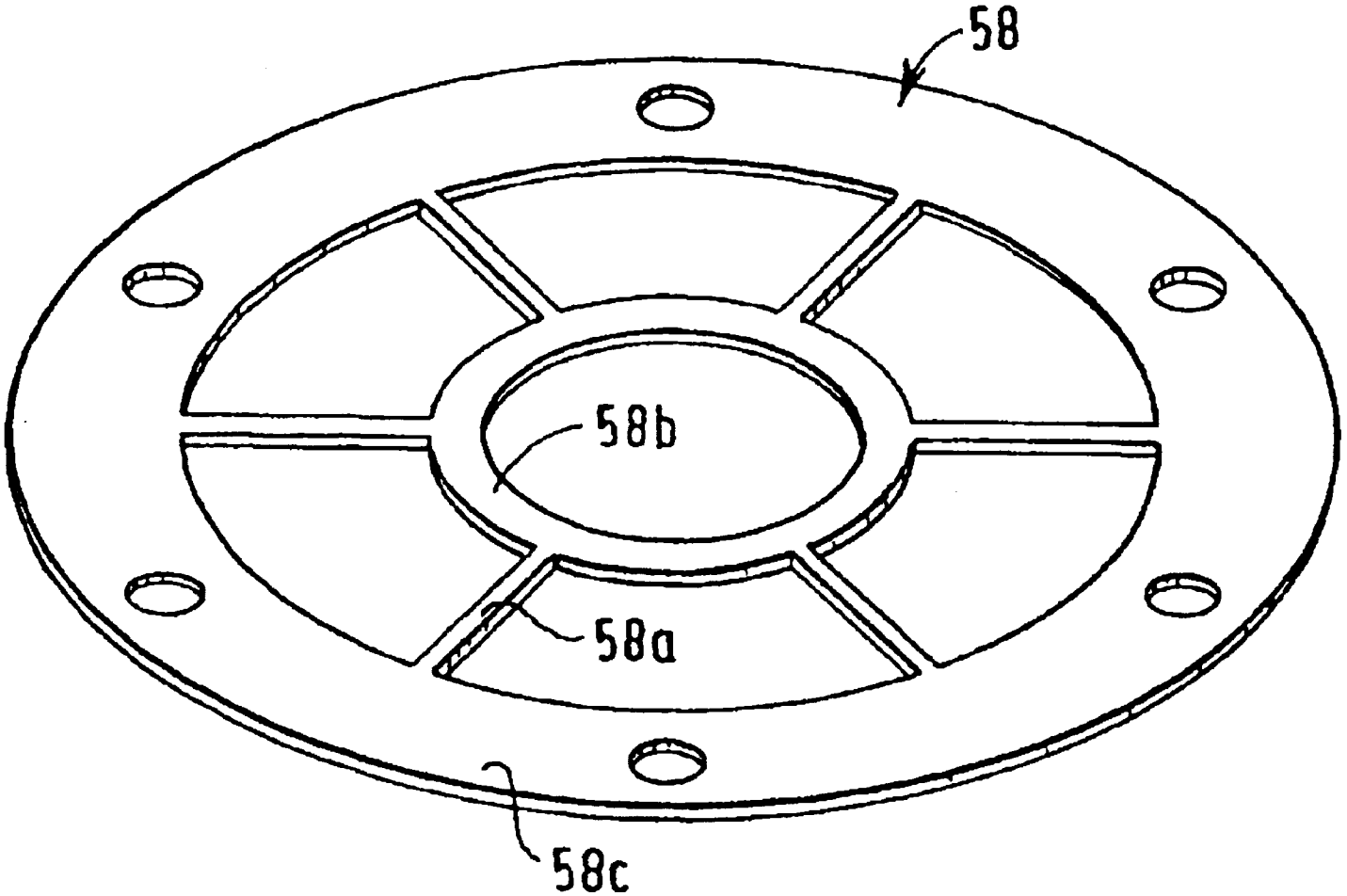
Figure 7:
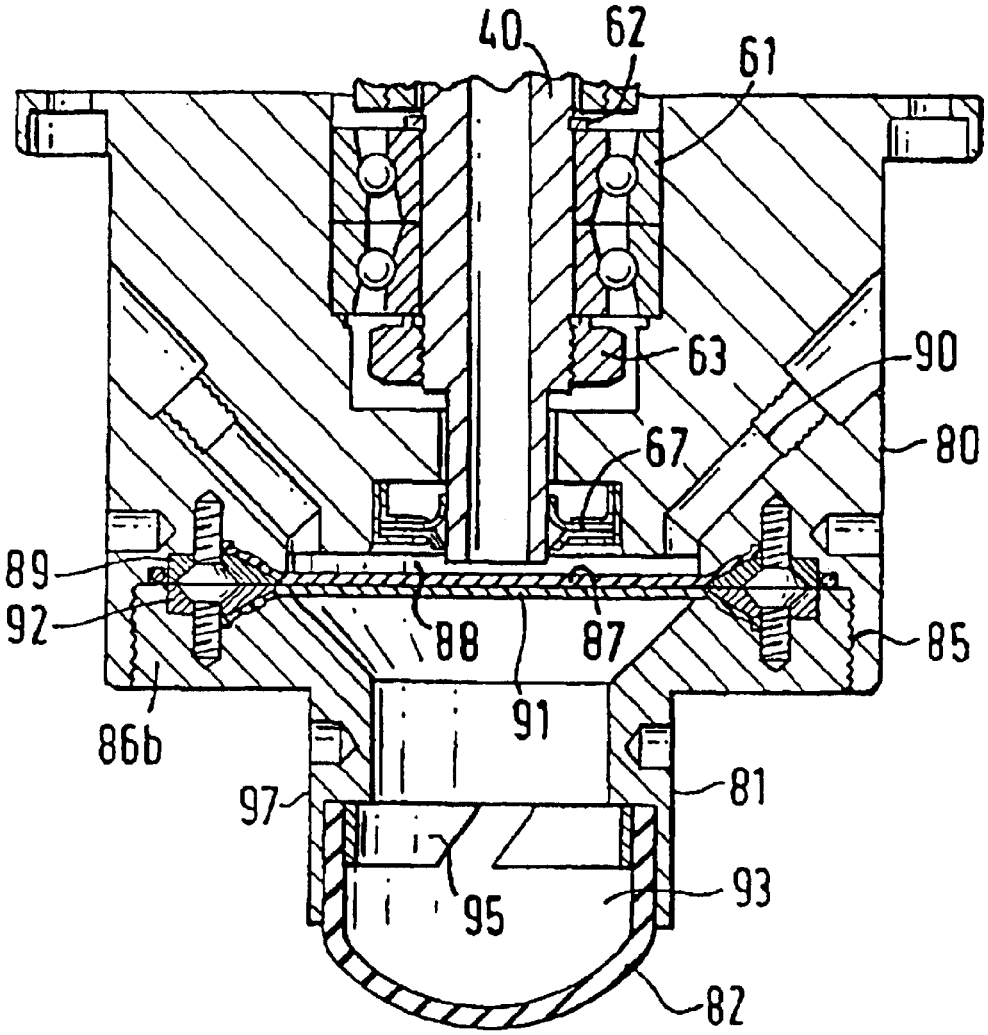
Figure 8:
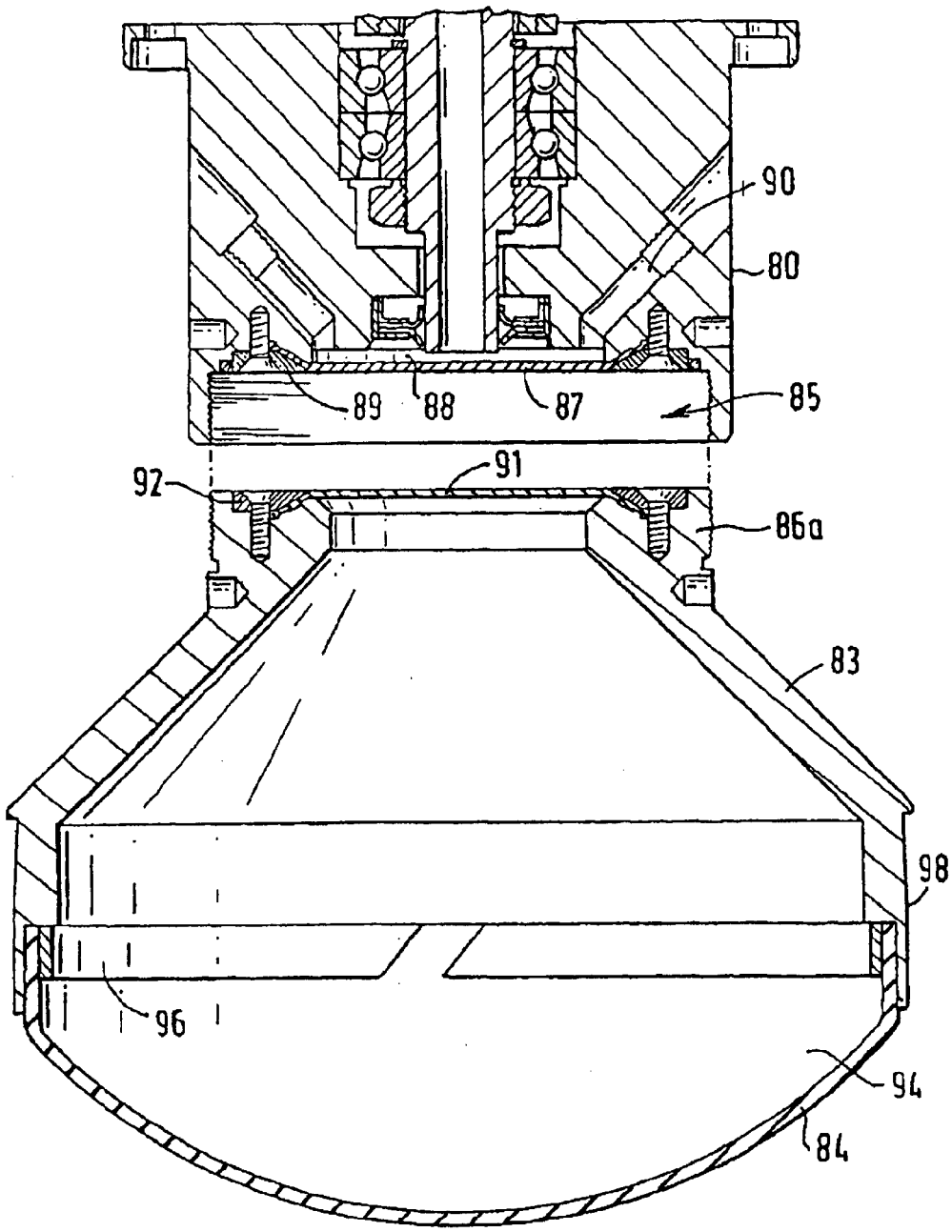
Figure 9:
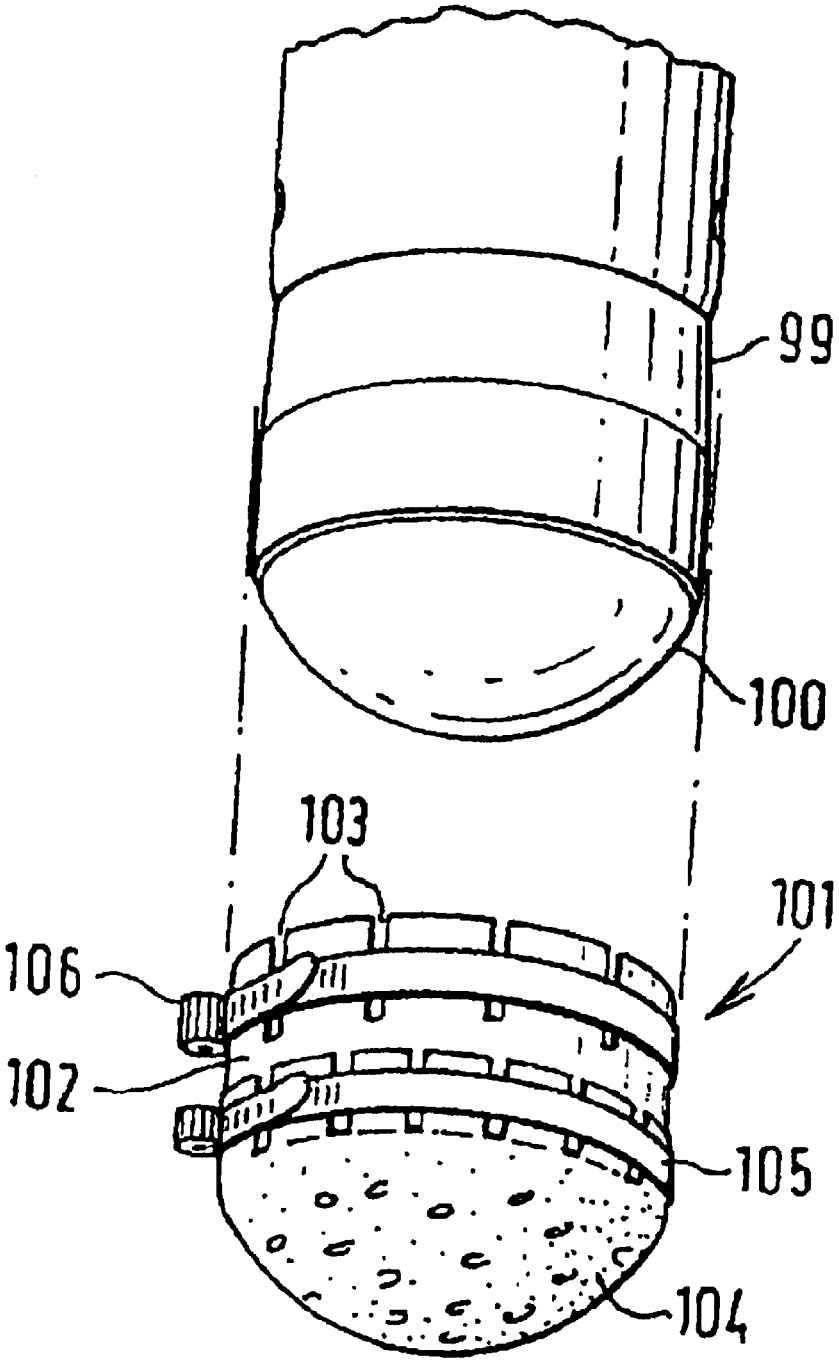
Figure 10:
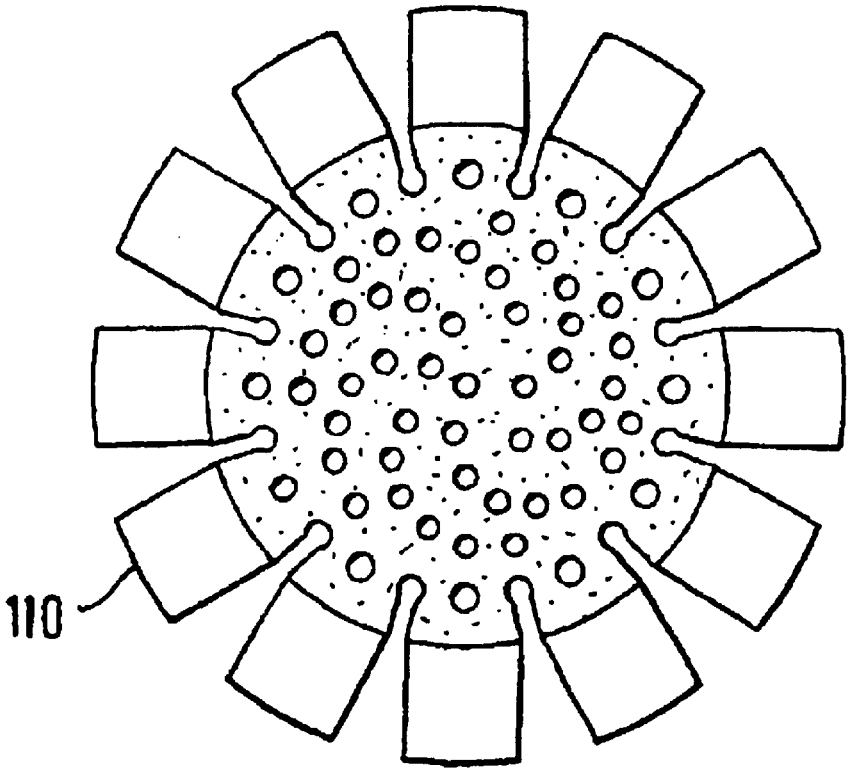
Figure 11:
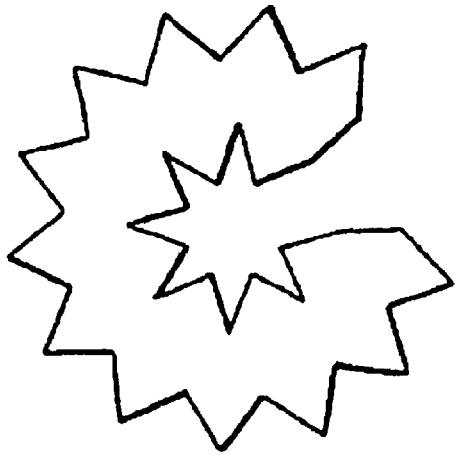
Figure 12:
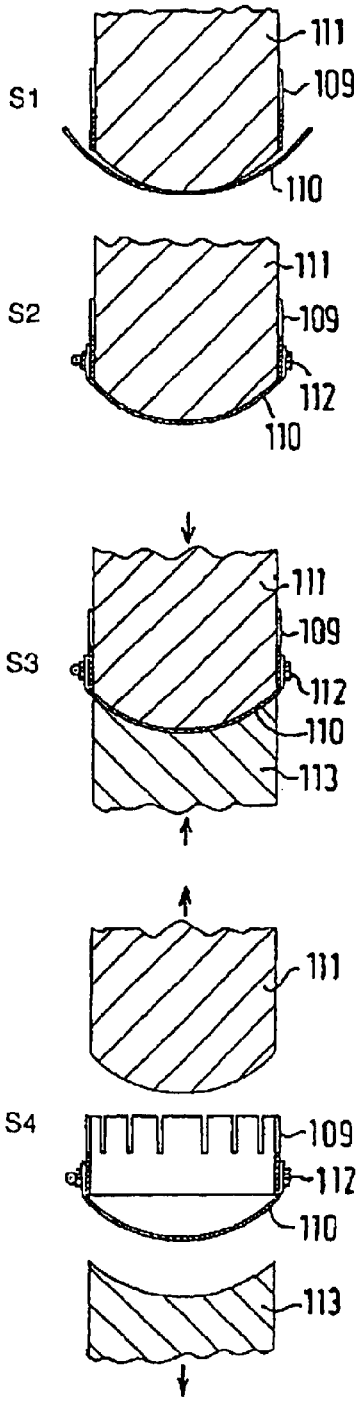
Figure 13:
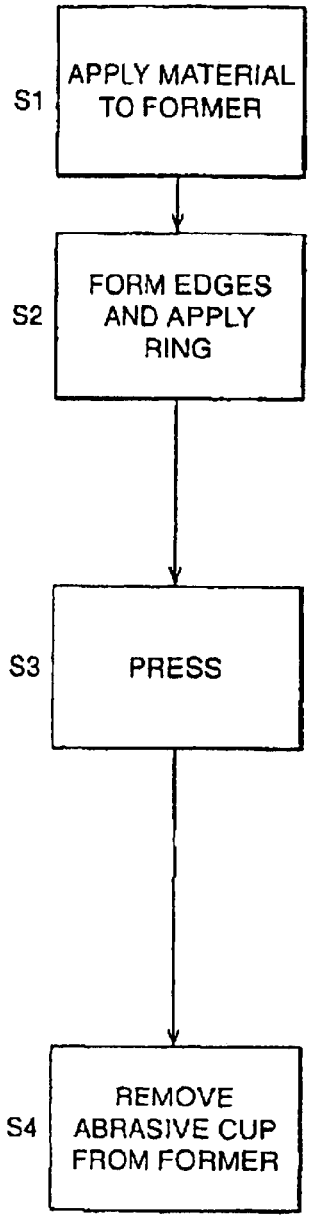

Embodiments of the present invention will now be described with reference to the accompanying drawings, in which:

FIG. 1 is a perspective view of a polishing apparatus using a soft tool in accordance with an embodiment of the present invention, FIG. 2 is a view of part of the polishing apparatus of FIG. 1 showing the turntable and the Z axis movement arrangement in more detail, FIG. 3 is a view of part of the polishing apparatus of FIG. 1, showing the arcuate track arrangements for providing the precession of the head, FIG. 4 is a sectional diagram through the head of the polishing apparatus of FIG. 1, FIG. 5 is a part sectional view showing in more detail the junction between the rotating part of the head and the stationary part of the head, FIG. 6 is a perspective view of the spoked member within the head, FIG. 7 is a sectional view of an alternative tool body fitted with a small tool head, FIG. 8 is another view of the tool body of FIG. 7 showing a large tool head for fitment thereto, FIG. 9 is a view showing the fitment of an abrasive cup to the tool head, FIG. 10 is a diagram of the sheet material used in the construction of the abrasive cup, FIG. 11 is a diagram of an abrasive sheet material optionally used in addition to the sheet material of FIG. 10 on the abrasive cup, FIG. 12 is a series of diagrams illustrating the operations carried out during the manufacture of the abrasive cup, FIG. 13 is a flow diagram showing the steps of manufacturing the abrasive cup.

Figure 14A:
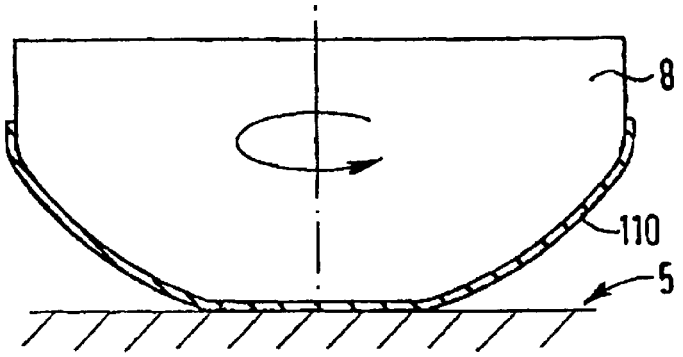
Figure 14B:
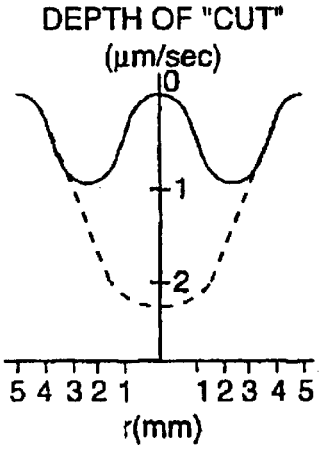
Figure 14C:
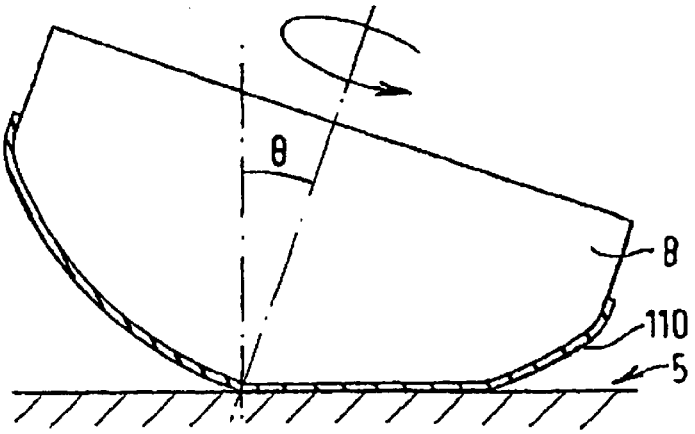
Figure 15:
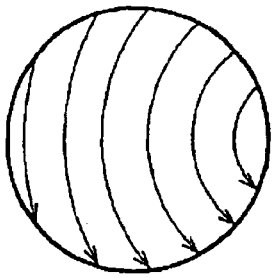
Figure 16:
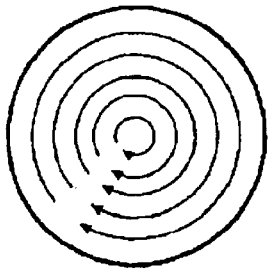
Figure 17:
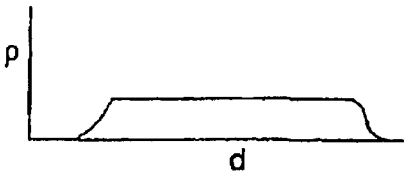
Figure 18:
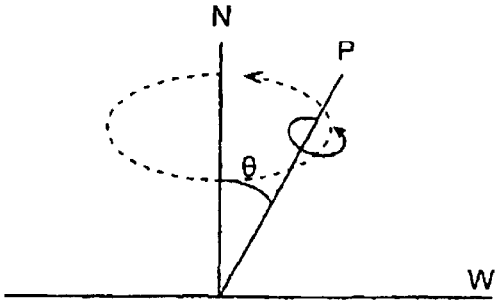
Figure 19:
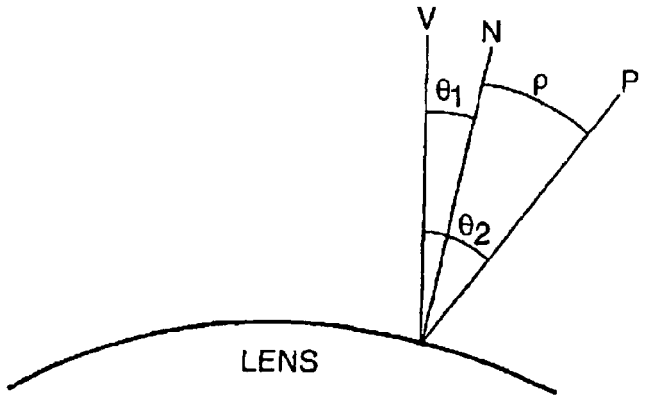
Figure 20:
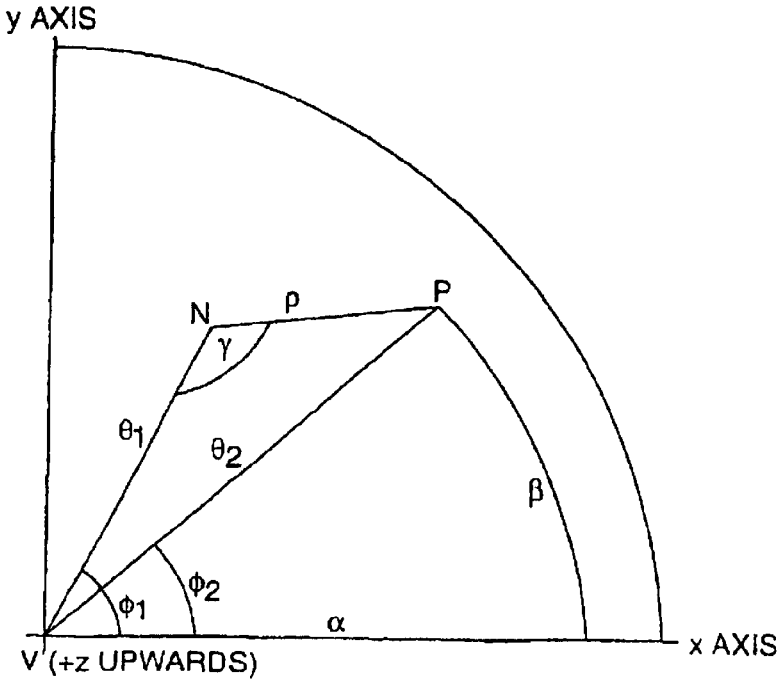
Figure 21:
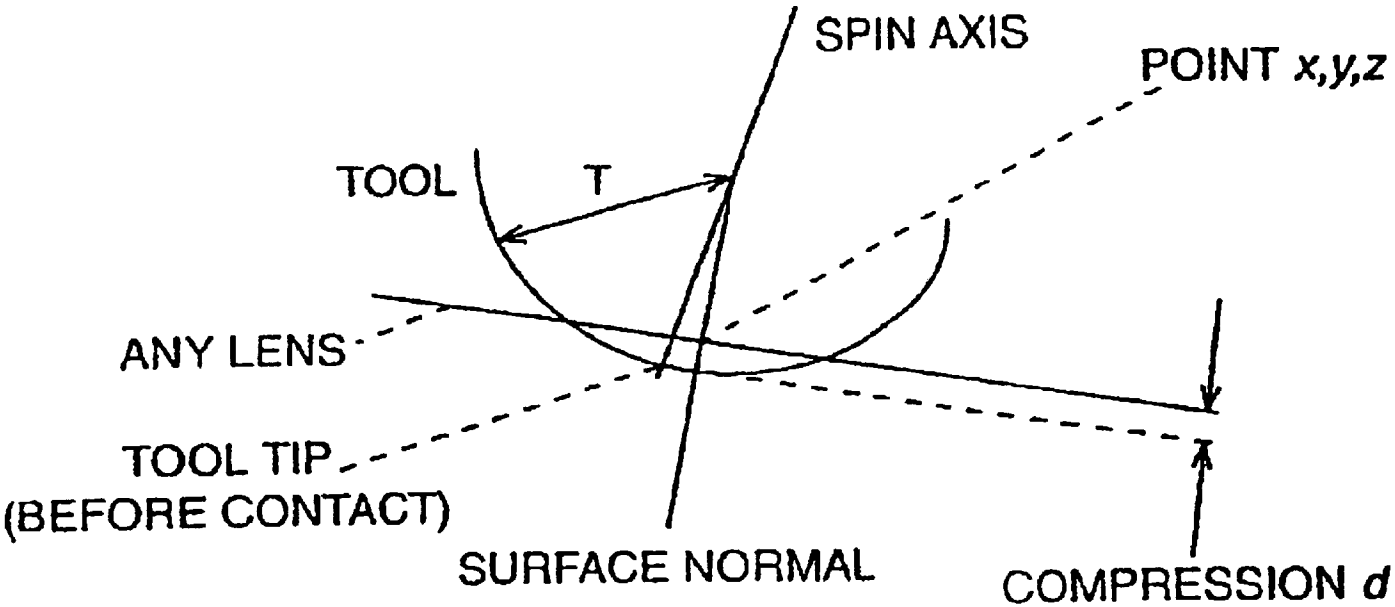
Figure 22:
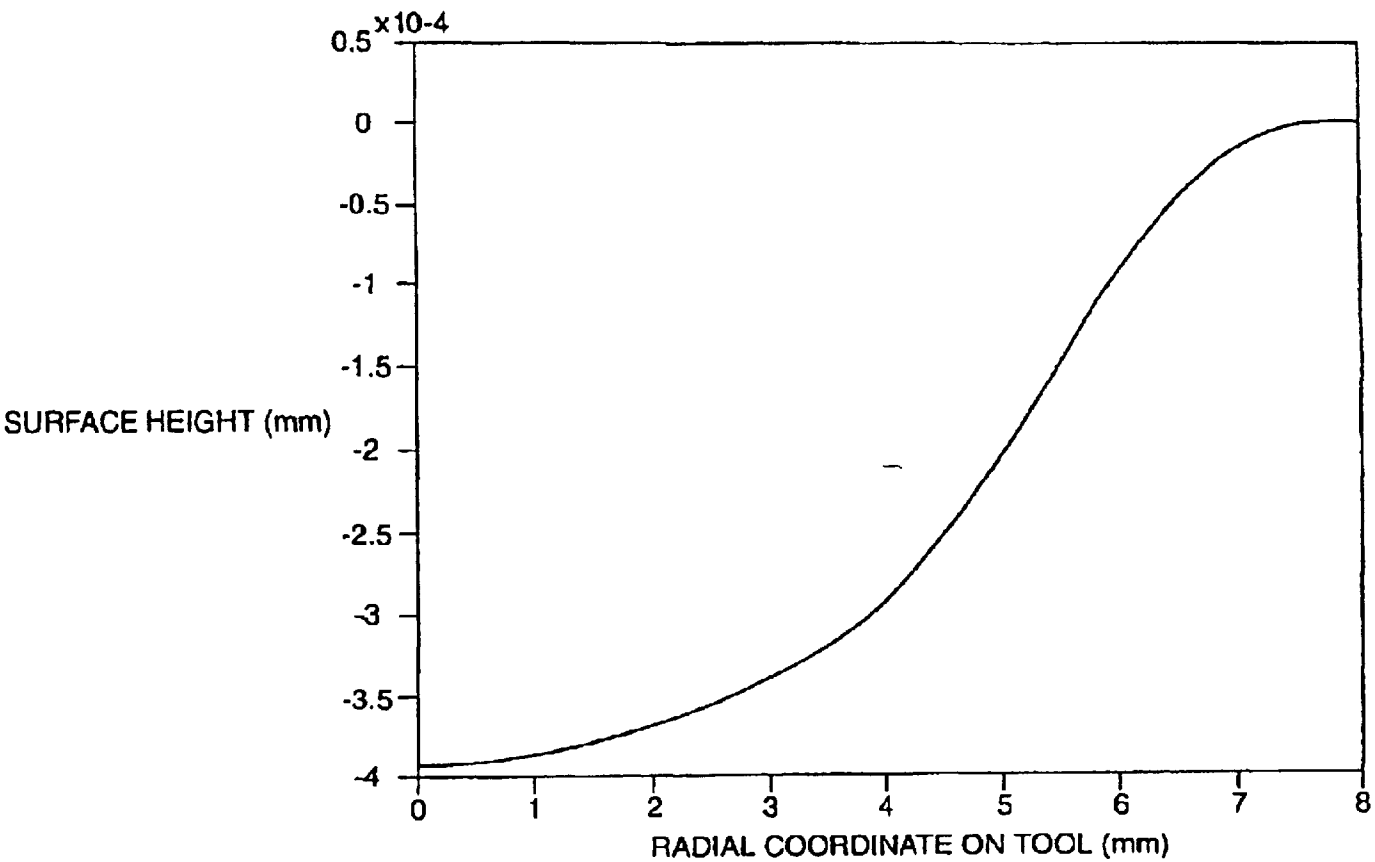
Figure 23:
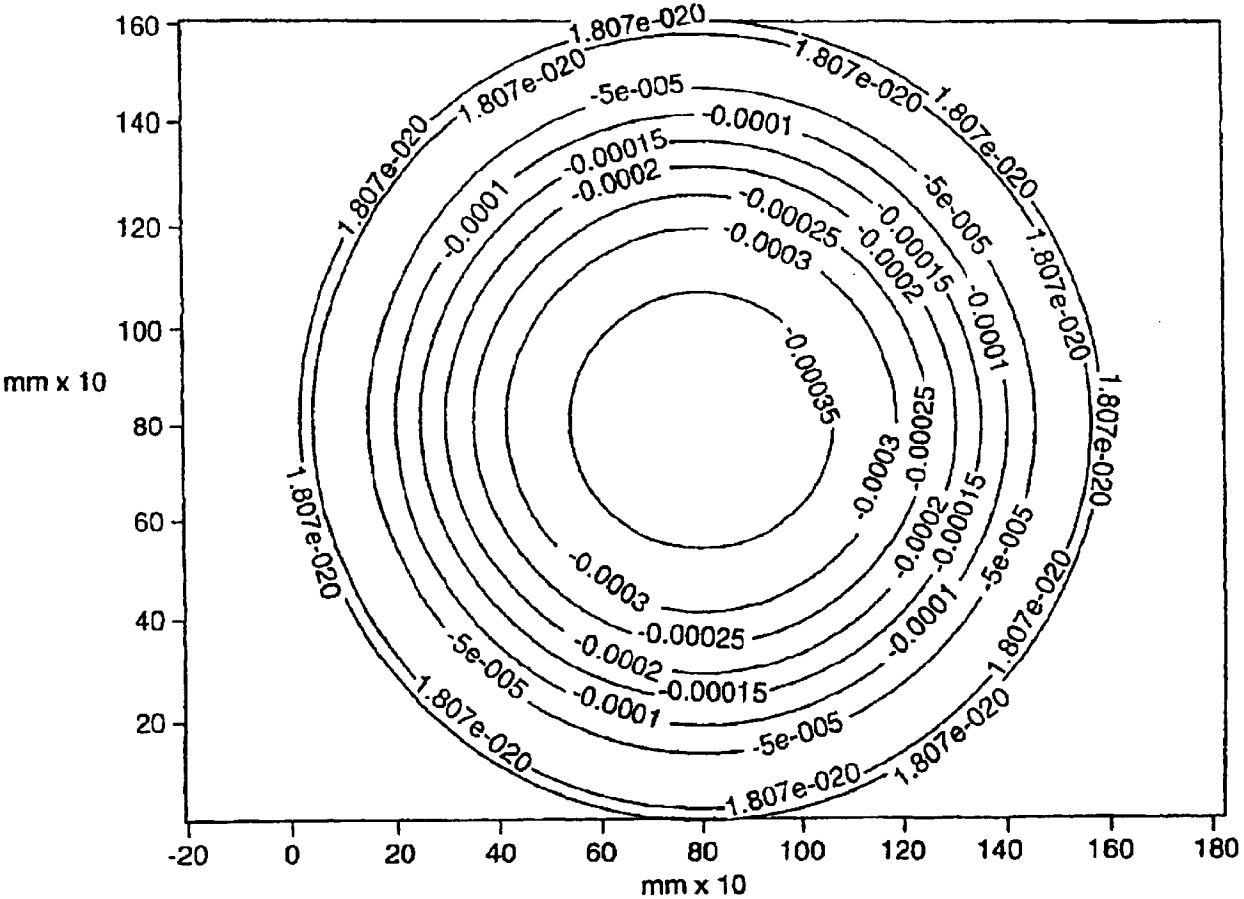
Figure 24:
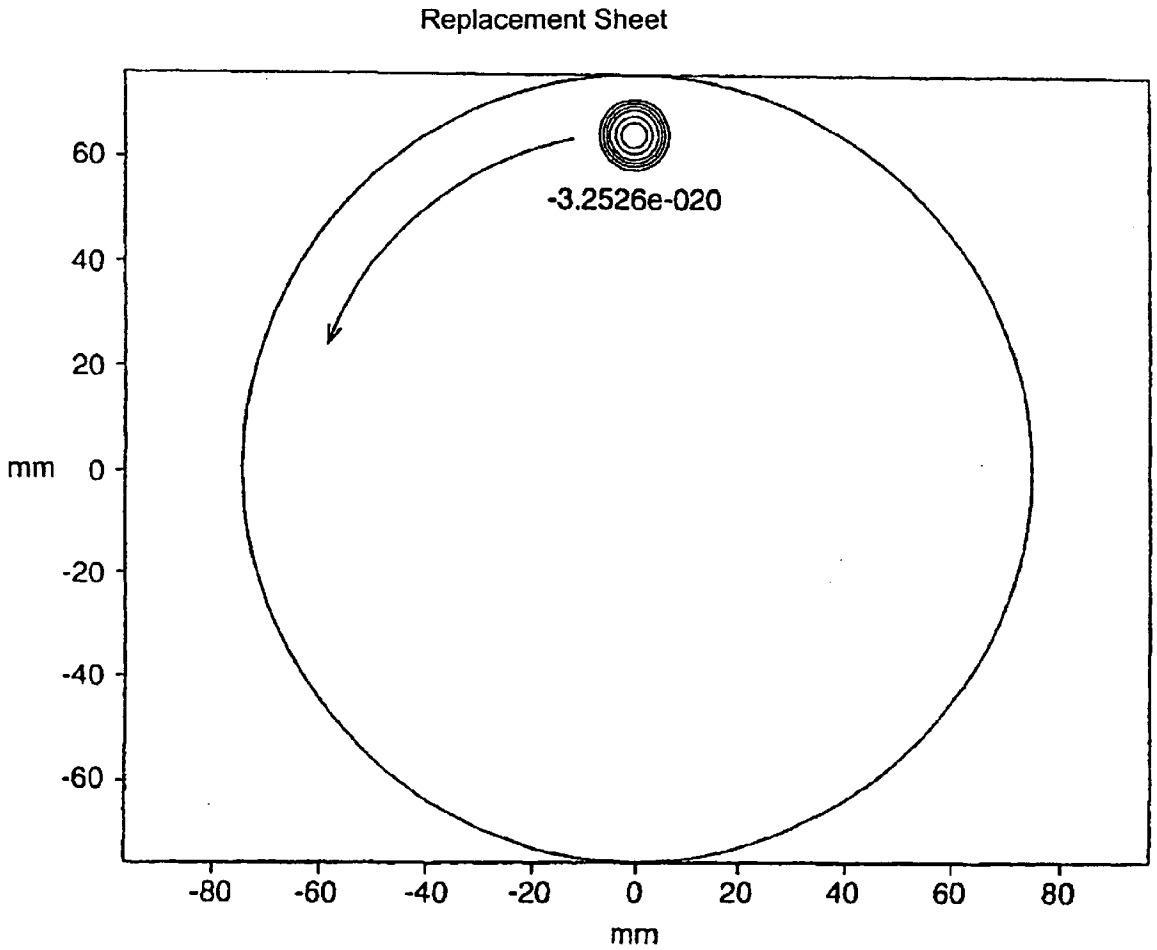
Figure 25:
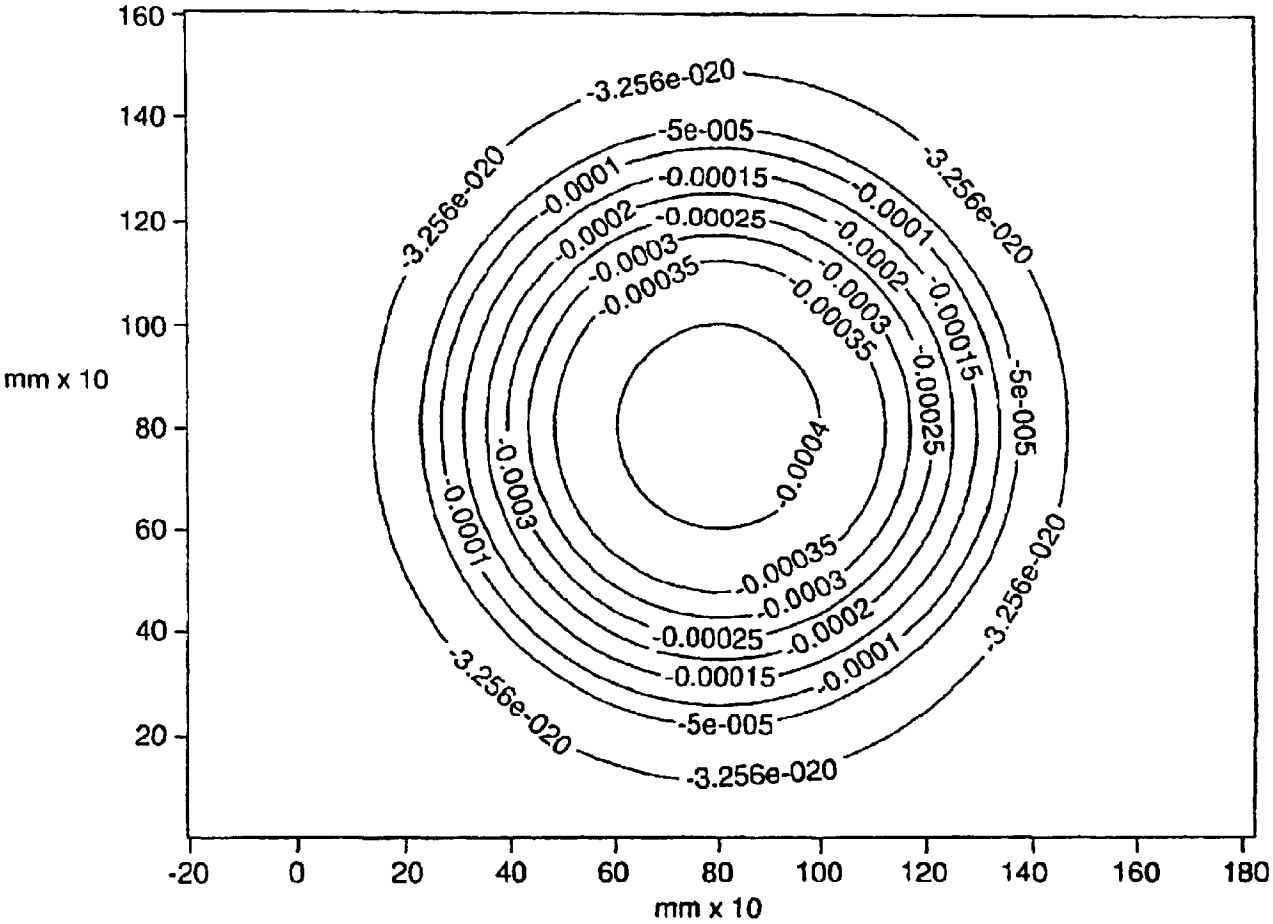
Figure 26:
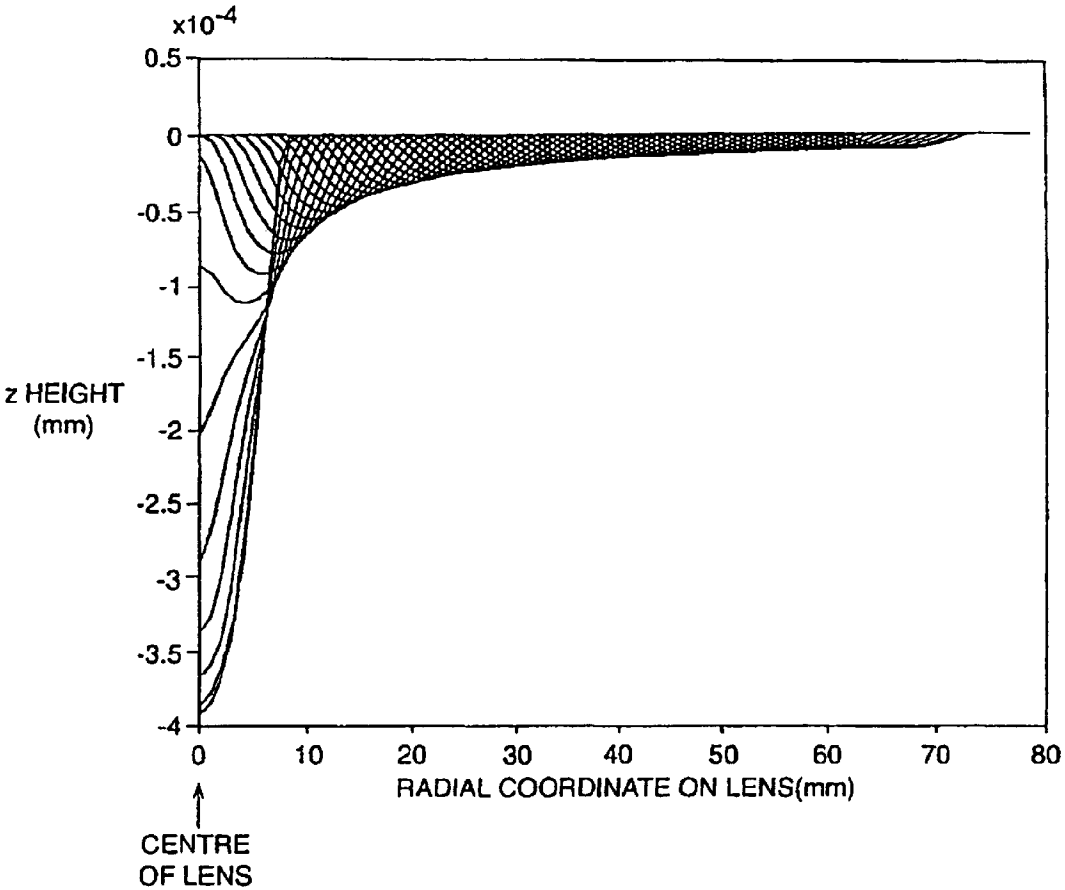
Figure 27:
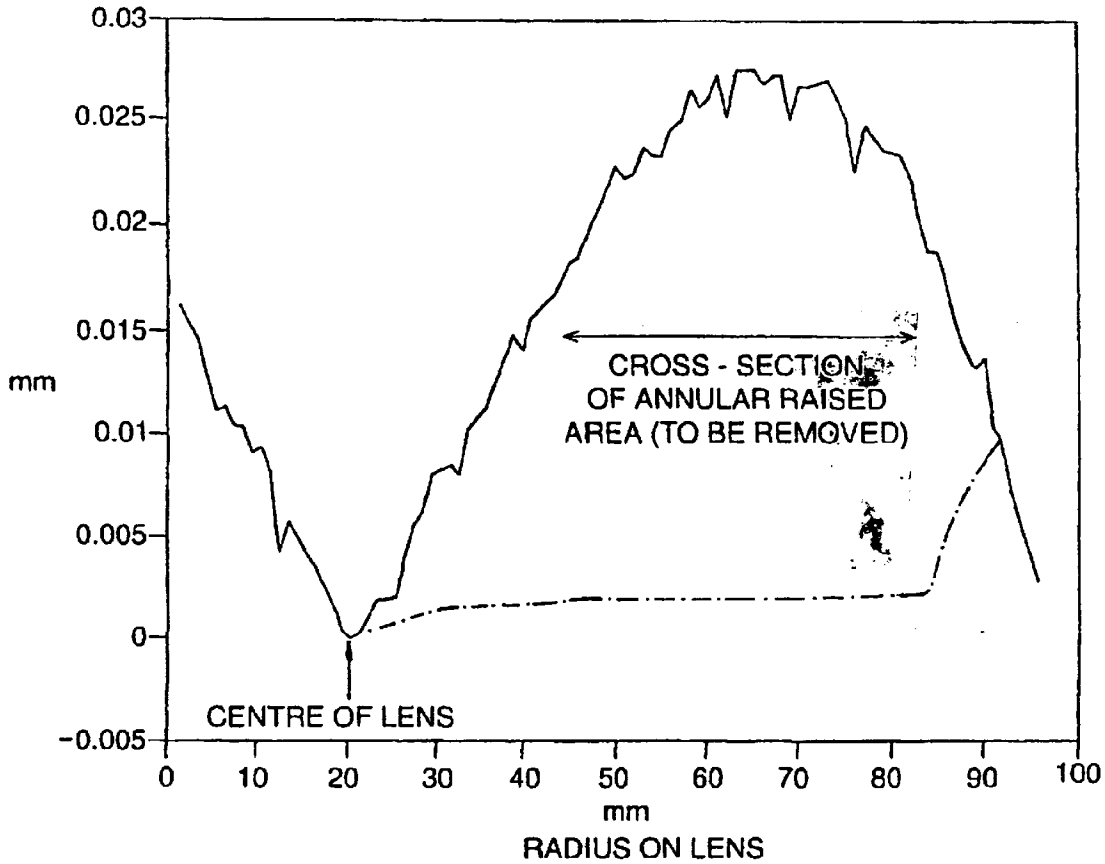
Figure 28:
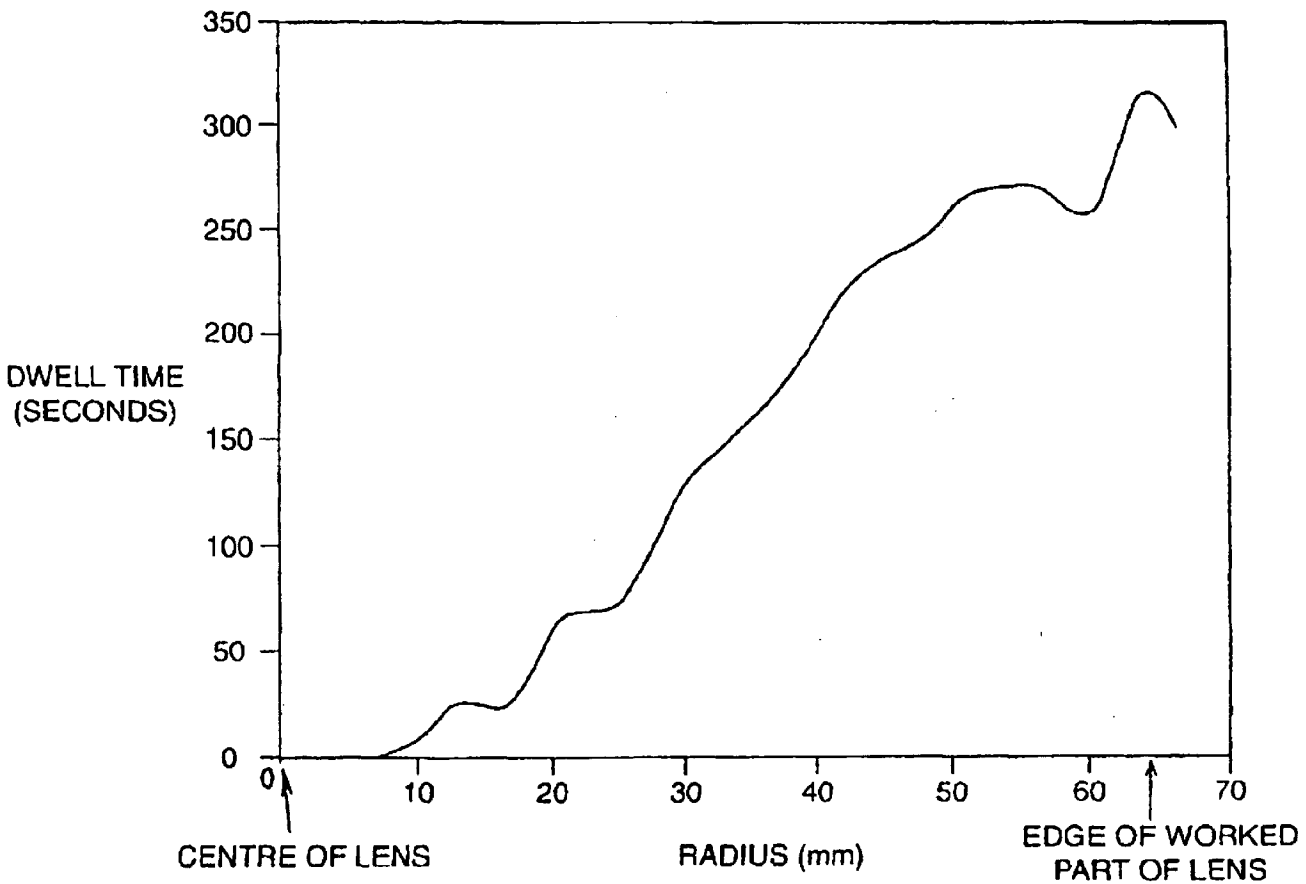
Figure 29:
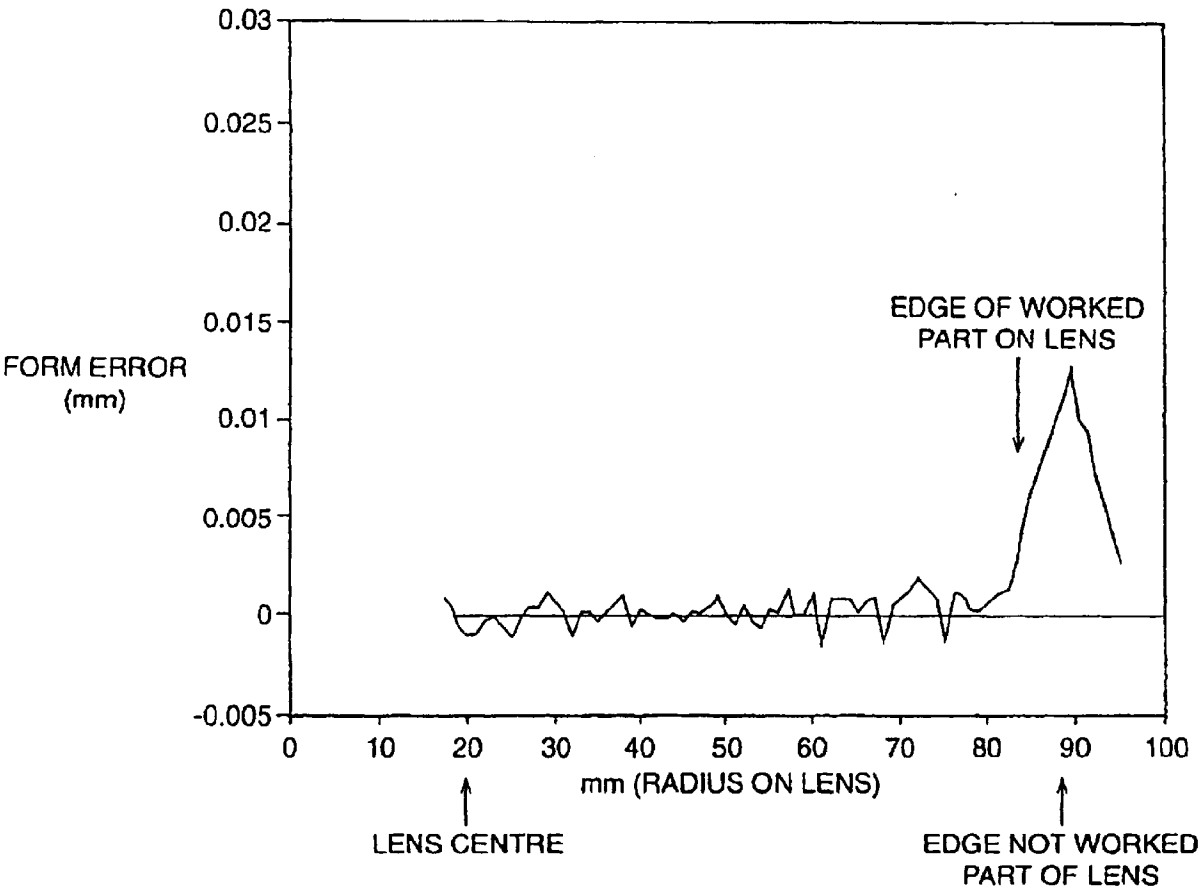
Figure 30:
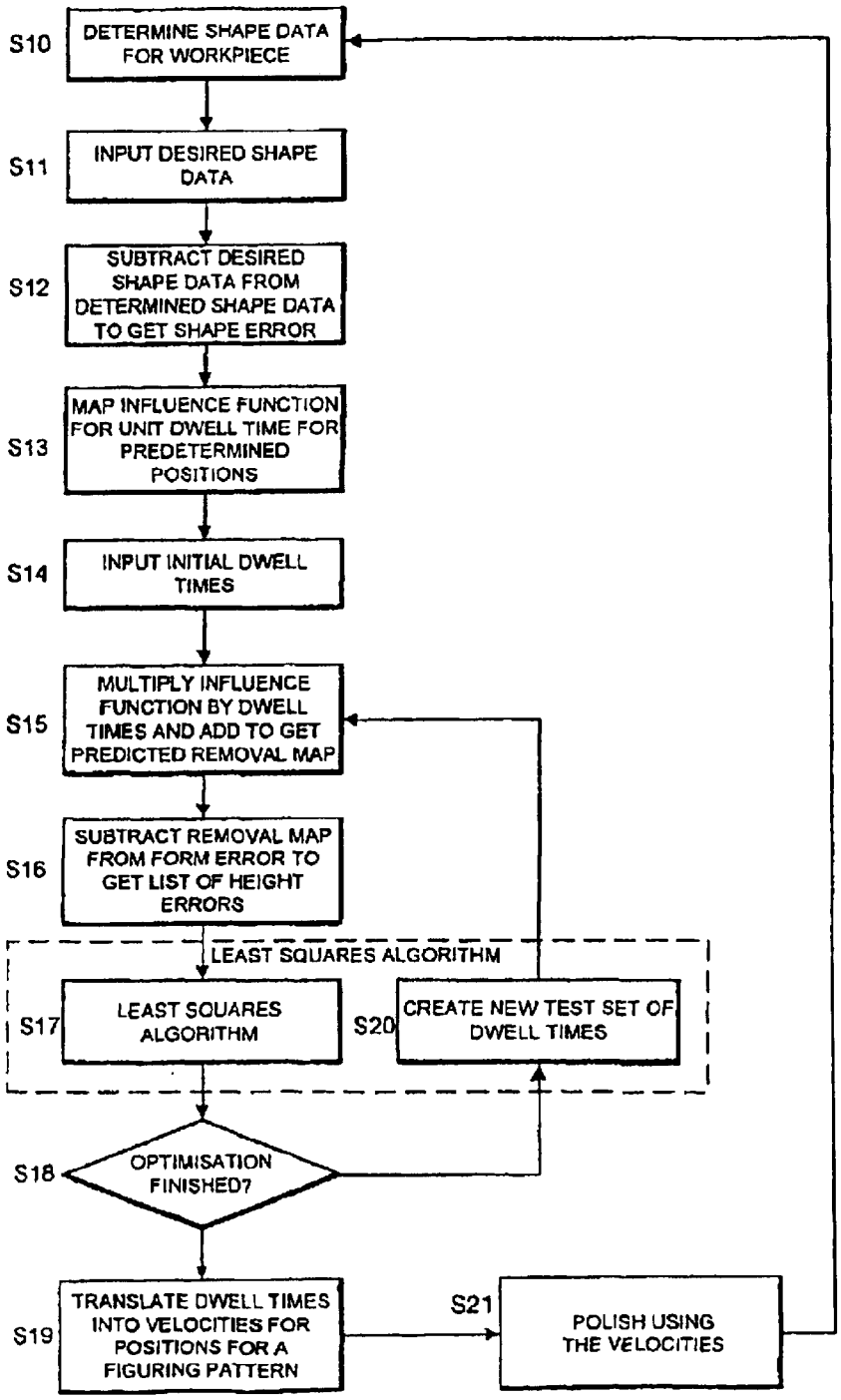
Figure 31A:
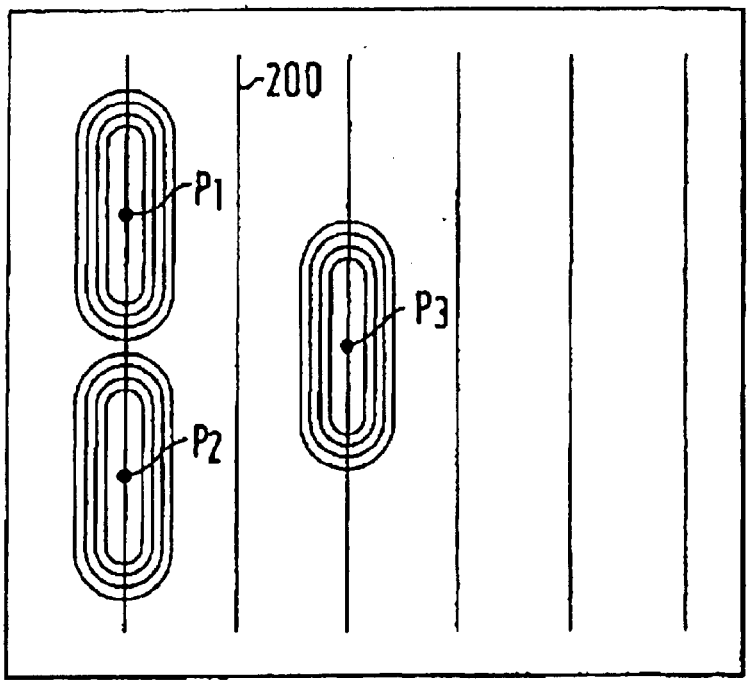
Figure 31B:
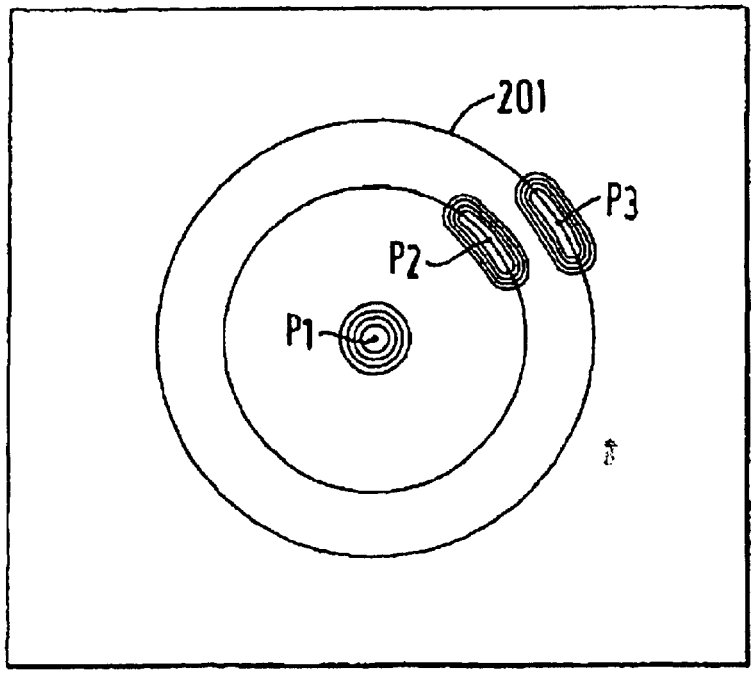
Figure 32:
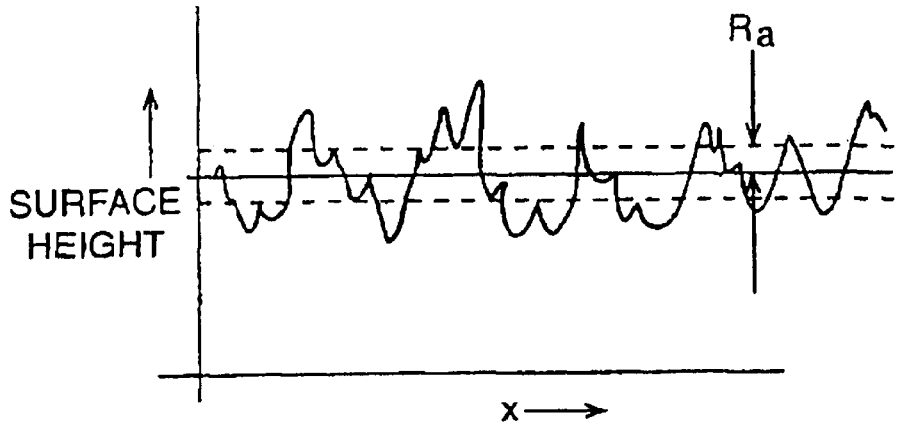
Figure 33:
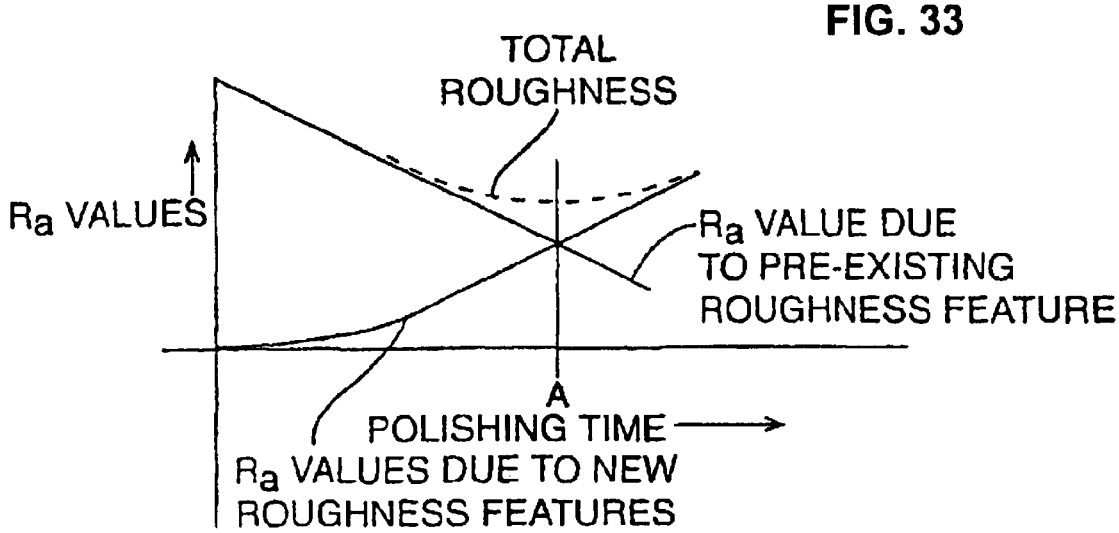
Figure 34:
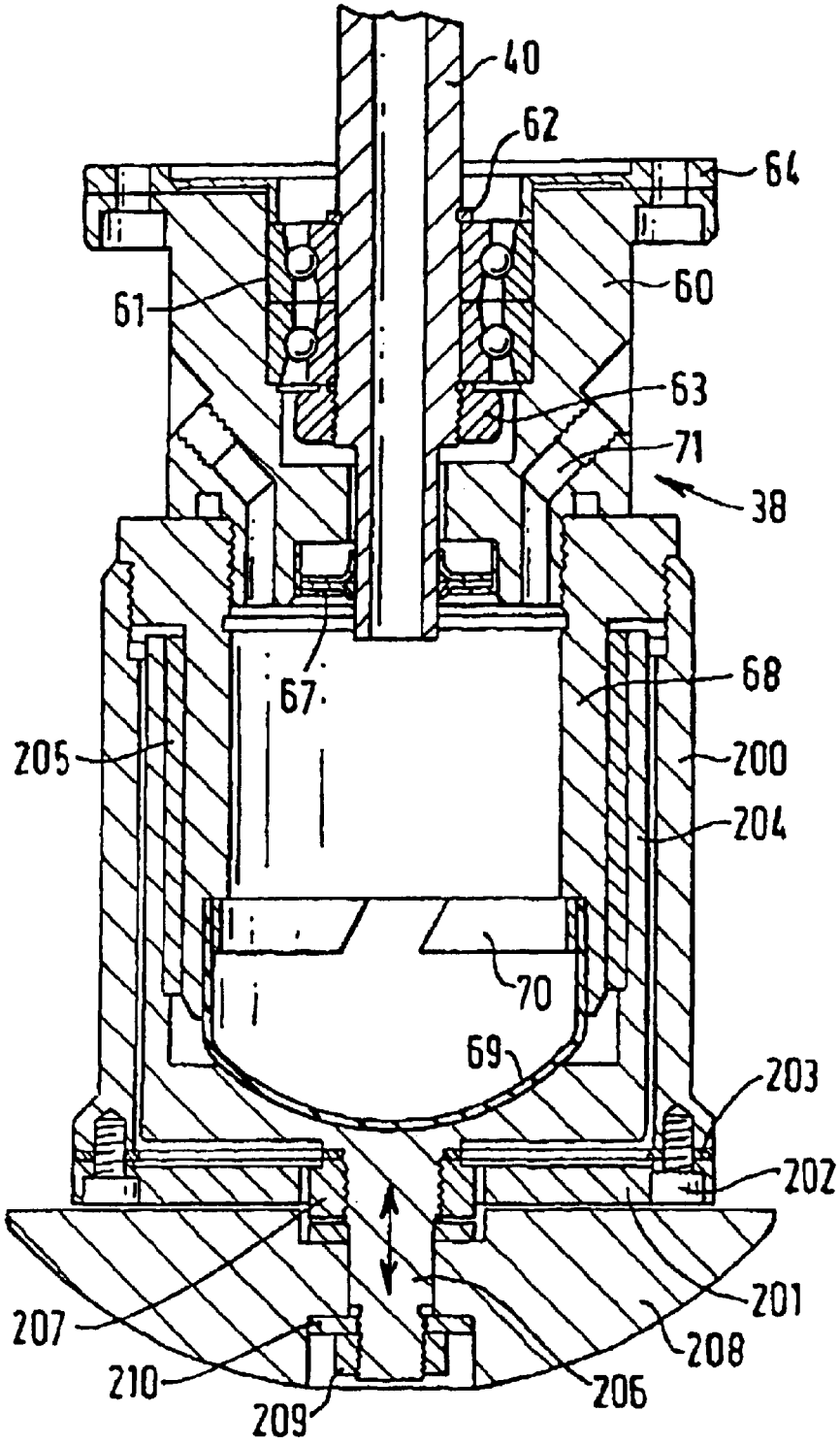

FIG. 14*a* schematically illustrates the prior art method of polishing using the soft tool, FIG. 14*b* is a graph illustrating the removal profile of the soft tool used in accordance with the prior art method and used in accordance with the present embodiment, FIG. 14*c* illustrates the method of using the soft tool in this embodiment, FIG. 15 is a diagram illustrating the pattern of removal of material from the workpiece with the soft tool used at an angle in this embodiment, FIG. 16 is a diagram of the pattern of removal of material from the workpiece using the prior art technique, FIG. 17 is a graph of the pressure distribution across the diameter of the soft tool as it is pressed against the workpiece, FIG. 18 is a diagram illustrating the precession of a head at a precession angle θ, FIG. 19 is a diagram illustrating the calculation of the angle of the precession, FIG. 20 is a diagram illustrating the information of FIG. 19 projected onto a sphere, FIG. 21 is a diagram illustrating the intersection of the tool and the surface of the workpiece, FIG. 22 is a cross section of the influence function, FIG. 23 is a two-dimensional map of the influence function of a tool, FIG. 24 illustrates the influence function projected onto a curved lens, FIG. 25 is an enlargement of a part of FIG. 24, FIG. 26 illustrates the grooves or ablation profiles formed in the workpiece, FIG. 27 is a profile of a part made lens which requiring work, FIG. 28 is a graph of the dwell times required for polishing the lens, FIG. 29 is a forecast of the resultant profile using the dwell times of FIG. 28, FIG. 30 is a flow diagram illustrating the polishing process, FIGS. 31*a* and 31*b* are diagrams illustrating dynamic influence functions mapped onto a workpiece surface, FIG. 32 is a diagram showing surface roughness, FIG. 33 is a diagram showing polishing to reduce surface roughness, and FIG. 34 illustrates an alternative working member.

FIG. 1 is a diagram of a polishing machine using a soft tool in accordance with an embodiment of the present invention.

A polishing machine comprises a robust table 1 resistant to vibrations. On the table 1 there is mounted an X-slide mechanism for movement in the x direction. On the X-slide mechanism 2 there is mounted a Y-slide mechanism 3 for movement in the y direction. On the Y-slide mechanism 3 there is mounted a turntable 4 for rotation in the direction of c. The turntable 4 is mounted on the Y-slide mechanism 3 via a z movement mechanism (not shown) for movement of the turntable 4 in the z direction. The turntable 4 has a holding surface onto which a workpiece 5 is mounted for polishing or abrading. Thus this arrangement provides for motion of the workpiece 5 in four axis; namely x, y, z and c.

The polishing machine is also provided with a back member 6 on which is mounted a pivot arrangement for pivotally moving a polishing head 7. The polishing head 7 is arranged for axial rotation and includes a working member 8 arranged at a lower axial end for polishing or abrading the workpiece 5. Thus the axial rotation of the working member 5 provides another axis for control: namely h.

The pivot mechanism mounted on the back member 6 comprises a first pivot member mounted 700 in an arm for pivoting the head 7 about a pivot point in the working member 8 in a first plane. The first pivot mechanism 700 is mounted on a second pivot mechanism 800 which provides for the pivoting of the head 7 about a pivot point in a plane perpendicular to the plane of pivoting of the first pivot mechanism 700 in the arm. Thus these two orthogonal pivoting mechanisms provide two further axes of control: namely a and b.

The back member 6 of the polishing machine also houses a computer control system 9 which includes a display 10 and control inputs 11. This allows a user to input controls to control the motion of the Workpiece 5 and of the working member B and to view displayed information regarding the polishing or abrading process.

Each of the axes of motion x, y, z, c, h, a and b are driven by respective drive mechanisms which in addition to driving motion in the axis, provides position information for use by the computer control system 9 to control the polishing or abrading process. The computer control system 9 is also provided with two further axes of control: namely the work done by the driving mechanism in rotating the working member 8 held on the head 7, and the pressure applied within the working member 8, as will be described in more detail hereinafter. Thus the computer control system 9 operates an algorithm which will be described in more detail hereinafter to control these nine axes in order to abrade or polish the workpiece 5 mounted on the turntable 4 to achieve a desired surface profile and/or surface quality such a smoothness The apparatus can be used to achieve any desired surface profile including the surface profile containing both concave and convex areas.

The construction of the x and y slide mechanisms for driving the workpiece in the x and y directions, is conventional: merely comprising conventional linear slides. Thus the construction of these mechanisms need not be described in more detail.

The construction of the z and c axes drive mechanisms will now be described in more detail with reference to FIG. 2.

FIG. 2 is a partial view of the relevant mechanisms carried on the x slide mechanism 2. On the y slide mechanism 3 there is provided a mounting plate 12 extending underneath, the y slide mechanism 3. The mounting plate 12 comprises an open box section in which is mounted the arrangement for moving the turntable 4 in both the 2 and c axes.

On a back face of the mounting plate 12 there is provided a guide mechanism 13 on which is mounted a motor housing 14 containing a motor 15 coupled via a shaft 16 to the turntable 4. The motor 15 is provided to rotate the turntable 4 in the c axis.

The motor housing 14 is arranged to be movable on the guide mechanism 13 in the z direction through the y slide mechanism 3. Since the turntable 4 moves in the z direction relative to an upper surface of the Y slide mechanism 3, rubber bellows 17 is provided to prevent the ingress of dirt into the mechanism.

The motor housing 14 is driven in the z direction along the guide mechanism 13 by a motor 18 which drives a shaft 19 supported by a support 20. An upper end of the shaft 19 is formed to have a screw threaded portion 21 which co-operates with a threaded sleeve 22 fixably mounted an the motor housing 14. Thus rotation of the threaded portion 21 by the motor 18 causes motion of the motor housing 14 in the z direction which will cause the turntable 4 to move the z direction.

The mechanism for pivoting the head 7 will now be described in more detail with reference to FIG. 3.

The head 7 is mounted at an upper end on a pair of parallel arcuate members 23. The arcuate members 23 have a radius of curvature centred on an axis BX which extends through the centre of the portion of the head 7 mounting the working member 8. The axis ax extends through the head 7 at a centre of the radius of curvature of the working member 8.

The head 7 includes a motor 24 driving a cog 25 to engagement with teeth on the arcuate members 23. The head is also provided with guide wheels 26 acting on either side of the arcuate members 23 in order to maintain the angle of the axis of the head 7 to the arcuate members 23. This arrangement ensures that as the motor 24 drives the end of the head 7 in the direction b, the head 7 pivots about the axis EX.

The end of the head 7 near the motor 24 is provided with hydraulic pipes 27 for transmitting hydraulic pressure into the head 7 and to the working member S as will be described in more detail hereinafter. Also, in the head 7 there is provided a motor for rotating the working member 3 in the direction h. This will be described in more detail hereinafter.

The accurate members 233 are mounted on a mounting plate 28. The mounting plate 28 is mounted at an end to allow pivoting in a perpendicular plane.

The mounting plate 28 is mounted at a lower part of its ends on a pivot plate 29. The pivot plate 29 is pivotably mounted on a pivot point 30. The pivot point 30 is mounted on & lower part of a mounting plate 31.

An upper part of the end of the mounting plate 28 is mounted on a motor plate 32. On the motor plate 32, there is mounted a motor 33 for driving a cog 34. The mounting plate 31 is provided with an arcuate member 35 having a center of its radius of curvature at the pivot point 30. The arcuate member 35 is provided with teeth to engage the cog 34 to allow the pivotal driving motion of the head 7 about a pivoting axis AX which intersects the pivot axis BX at the portion of the head 7 near the working member 8. The point of intersection of the pivot axes AX and BX is the central of the radius of curvature of the working member 8. The motor plate 32 also mounts guide wheels 36 to guide the pivotal motion of the head 7.

It can be seen from FIG. 3 that the provision of the two orthogonal arcuate members 23 and 35 provide for the pivotal motion of the bead about a virtual pivot point. This arrangement provides for the precession of the head about the virtual pivot point. It should be noted that the precession of the head can be undertaken as steps and need not be undertaken by taking an angular precession i.e. by rotating the upper part of the head through a circle. Instead, the upper part of the head mounted on the arcuate members 23 can move linearly to opposed precession positions. Patterns of movement of the upper part of the head will depend upon the pattern of precession required. Since the precession of the heads require considerable movement of the upper part of the head using the arcuate members 33 and 35, the preferred method of operation of the machine is to perform figuring of the whole of the workpiece (or as much of the workpiece as is necessary) using one precession position. The precession position can then be changed and figuring of the workpiece is carried out again. This can be repeated for all required incremental precession positions.

Details of the construction of the head 7 and the working member 8 will now be described in more detail with reference to FIGS. 4 to 6.

The head 7 comprises a fixed part 37 and a rotating part 38. The rotating part 38 carries the working member 8.

An upper part of the head 7 comprises a block 39 to which the motor 24 is fixed. Extending from within the block 39 there is provided a stationary shaft 40. The stationary shaft 40 has a head 41 which is mounted at three points in the plane of this sectional diagram and at four equally spaced points in a plane orthogonal to this sectional diagram. The mounting points of the head 41 allow for the load experienced by the head 41 to be measured. In order to provide this there are provided three load cells 42 (two shown in the plane of this sectional diagram and one lying in the orthogonal direction). The load cells 42 are preloaded thus avoiding the need for five load cells; one for each mounting point of the head 41. The head 41 is mounted at each point, via load cell 42 where present, on support pins 43. The support pins include two waisted portions to reduce any lateral tension experienced by the load cell 42. One end of the support pin 43 engages the head 41 at the mounting points. The other end of the support pin 43 is mounted on a steel ball 44 which sits in a cup 45 which is biased by a spring 46 against the block 39. In this way, the head 41 of the stationary shaft 40 is allowed to move when both a lateral and vertical force is experienced by the shaft 40. The lateral and vertical loads on the shaft can be measured by the load cells 42. Lateral loads on the shaft 40 will be experienced due to a frictional force as the working member engages the surface of the workpiece 5. The vertical force will be dependent upon the position of the head 7 in relation to the workpiece and the pressure within the working member 8.

To provide some rigidity to the support of the stationary shaft 40, the stationary shaft 40 is coupled to the block 39 by a resilient bellows 47. The stationary shaft 40 extends the length of the head 7 from the block 39 to a fluid chamber 48 sealed by the working member 8 at the lower end of the head 7. The stationary shaft 40 is hollow and contains fluid for the transmission of hydraulic pressure to the fluid chamber 48. Within the head 41 of the stationary shaft 40 there is provided two opposed inlets (only one shown) which connects to the hydraulic pipes 27 to allow for the transmission of hydraulic pressure from outside the head 7 to the fluid chamber 48.

Below the block 39, the stationary part of the head 7 includes a motor housing 50 enclosing a stator 51 and a rotor 52. The stator 51 is fixed to the motor housing 50. The rotor 52 is fixed to a rotating sleeve 53 which rotates about the stationary shaft 40 and within the motor housing 50. The rotating sleeve 53 is mounted on upper bearings 54 and lower bearings 55 within the motor housing 50. At an upper end of the rotating sleeve 53 there is provided a position encoder 56 for providing a signal indicating the speed of rotation.

The lower end of the rotating sleeve 53 extends out of the motor housing 50 around the stationary shaft 40 to drive the rotating part 36.

FIG. 5 shows in more detail the interface between the stationary part 37 and the rotating part 38.

As can be seen more clearly in FIG. 5, the lower bearings 55 are held in position by a bearing ring 57 which has an inner screw thread to engage an outer screw thread on a lower part of the rotating sleeve 53. The lower part of the rotating sleeve 53 carries a spoked member 58. The spoked member 58, as shown in more detail in FIG. 6, has an inner annular ring 58*b* for engaging the lower part of the rotating sleeve 53 and this is held in place by a locking ring 59. The spoked member 58 includes spokes 58*a* extending from the inner annular ring 58*b* to an outer annular ring 58*c*. The outer annular ring 58*c* engages the rotating part 38 in order to drive the rotation thereof. The purpose of the spoked member 58 is to provide rotational coupling between the rotating sleeve 53 and the rotating part 38 whilst allowing translational and vertical forces experienced by the rotating part 38 to be transmitted along the stationary shaft 40 to be detected by the load cells 42.

The rotating part 38 comprises a housing 60 rotationally carried by bearings 61 on the stationary shaft 40. The bearings 61 are held between an upper locking ring 62 and a lower locking ring 63. An upper plate 64 is provided to act with the housing 60 to clamp the outer annular ring 58*c* of the spoked member 58. The upper plate 64 is also provided with a dirt ingress prevention arrangement comprising two concentric sleeves 65 each with holes 66 provided at lower regions thereof. The sleeves 65 extend into an annular recess provided in a lower part of the motor housing 50. This arrangement provides a long path length for the ingression of dirt into the bearing 55 and 61. Any dirt which should find its way in past the sleeves 65 will tend to be thrown out to the holes 66 by centrifugal action.

Within the housing 60 there is provided a fluid seal 67 to provide a seal between the housing 60 and the stationary shaft 40.

Fixed to the housing 60 is a tool housing 68 on to which is mounted a membrane 69. The membrane 69 is bulbous and is held at its periphery in the tool housing 68. The periphery of the membrane 69 comprises a cylindrical portion which fits into a cylindrical recess of the tool housing 68. A clamping ring 70 is provided to clamp the membrane 69 against the inner face of the tool housing 68. The tool housing 68 and the membrane 69 together form the fluid chamber 49 which communicates with the passage within the stationary shaft 40 to allow for hydraulic pressure to be transmitted via the hydraulic pipes 27 to the fluid chamber 48. The control of the pressure within the fluid chamber 48 controls the stiffness of the resilient working member 8. The hydraulic pressure in the fluid chamber 48 is a parameter which is controlled during the polishing or abrading operation at the machine.

The housing 60 is provided with fluid bleed passages 71 to allow for the bleeding of any air within the fluid chamber. The fluid chamber is filled with an incompressible fluid such as an oil-in-water emulsion or glycol.

A removal abrasive sup 101 is provided over the membrane 69 to provide the working member 8 with a working surface for polishing or abrading the Workpiece. This will be described in more detail hereinafter with reference to FIG. 9.

Thus it can be seen from FIGS. 4 to 6 that this arrangement provides not only for the control of the pressure within the fluid chamber 48, but also allows for the measurement of the translational and vertical forces experienced by the working member 9 when rotating against the workpiece surface.

The embodiment of the invention illustrated in FIGS. 4 to 6 does not allow for the easy replacement of the working member 8 since the fluid seal will be broken.

FIGS. 7 and 8 illustrate an alternative embodiment wherein the housing 60, the tool housing 68 and the membrane 69 are replaced with an alternative arrangement. In this embodiment of the present invention a housing 80 allows for the interchanging of tool housings. In FIG. 7 the tool housing 81 holds a small sized membrane 82. In FIG. 8, the tool housing 83 has a large sized membrane 84.

The housing 80 is provided with a threaded axial recess 85 to receive a threaded portion 86*a* or 86*b* of the tool housing 81 or 83. Within the recess 85 the housing 80 is provided with a pressure transmission membrane 87 extending across a small fluid chamber 88 and held in place by a clamping ring 89. The housing 80 is also provided with a bleed port 90 for the bleeding of air out of the chamber 88.

Thus, fluid pressure transmitted down the cavity of the stationary shaft 40 is transmitted to the fluid chamber 88 which transmit the pressure to the pressure transmission membrane.

The tool housing 81 or 83 is provided with a similar opposed pressure transmission arrangement comprising a pressure transmission membrane 91 held in place by a clamping ring 92. The pressure transmission membranes are arranged to contact one another to allow for the transmission of fluid pressure across the membranes whilst allowing the housing 80 and the tool housings 81 or 83 to be separated without breaking the hydraulic seal.

Within the tool housing 51 and 83, the respective membranes 82 and 84 form respective fluid chambers 93 and 94. As for the previous embodiment illustrated in FIG. 4, the membranes 82 and 84 have an outer periphery forming a sleeve which fits in a recess in the respective tool housings 81 and 93. Respective membranes 82 and 84 are held in place by respective clamping rings 95 and 96.

An outer region of the tool housing 81 and 83 adjacent to the respective membranes 82 or 84 is formed into a cylindrical face 97 and 98 with a slight taper (2°) away from the membrane 82 and 84. The formed tapered face 97 and 98 is for receiving an abrasive cup as will be described in more detail hereinafter.

As can be seen in the drawings, the membranes 82 and 84 comprise thin membranes that can deform when they contact the surface of the workpiece. They are able to conform to the surface of the workpiece. The area of contact between membrane 82 or 84 and the surface of the workpiece will depend upon proximity of the tool housing 81 or 83 to the surface of the workpiece; the closer the tool housing 81 or 83 comes to the surface of the workpiece, the more compressed the membrane 82 or 64 will become and thus there will be a larger area of contact between the membrane 82 or 84 and the surface of the workpiece.

Because the membrane 82 or 84 is clamped internally so that its outer surface clamps to the inner surface of the tool housing 81 or 83, its outer dimensions will not vary in accordance with the degree of force using in clamping. This ensures uniformity of the size of the working member in view of the replaceability of the membrane 82 or 84.

When building the interchangeable tool heads, the fluid chambers 93 and 94 can be filled with fluid by assembling the tool heads immersed in the fluid i.e. The pressure transmitting membrane 91 can be clamped when the tool is submerged in the fluid.

The radius of curvature of the membranes 82 and 84 is larger than the radius of the aperture into which it fits in the tool housing 81 or 83. In this way the membrane only comprises an arcuate portion and not a hemispherical portion. Thus the total curvature of the bulge of the membrane 82, 84 is not large. This is important when consideration is given to the application of an abrasive sheet material to the membrane 82 or 84.

The fitment of an abrasive cup to the tool head will now be described with reference to FIG. 9.

The tool head comprises the membrane 100 and a tapered cylindrical surface 99 which tapers away from the membrane 100 to receive the abrasive cup 101. The abrasive cup 101 comprises a cylindrical sleeve 102 having slots 103 cut into an upper end thereof. At a lower end of the sleeve 102 a working material 104 is arranged over the sleeve 102 and clamped around the sleeve 102 by clamp 105. The working material 104 can also be fixed by adhesive to ensure that it could not become separated from the sleeve.

The abrasive cup is arranged to fit over the tapered cylindrical surface 99 of the tool head. By clamping the upper part of the sleeve 102 using a clamp 106, the sleeve 102 can be made to contract and grip onto the tapered cylindrical surface 99. In this way the working material 104 is laid over the membrane 100. Because the cylindrical surface 99 is tapered, it cannot work lose during abrading or polishing. This is important, since if the ring were to come loose during polishing or abrading, serious damage to the workpiece could be inflicted.

The working material can be a conventional polishing cloth material with which an abrasive slurry is used. Alternatively, the working material can comprise a sheet with an abrasive material bonded thereto or impregnated therein so that when polishing, an additional abrasive material e.g. a polishing paste is not necessary. It is only necessary in this latter embodiment to use a fluid to cool the workpiece and tool, to lubricate the polishing process, and to carry the abraded particles away from the polishing area. With a careful selection of bonded abrasive material, this can increase the predictability of the polishing process.

The choice of abrasive material bonded on the tool impregnated in the sheet will depend upon the application. For example, when polishing glass diamond is not usually suitable for achieve the finest optical finish and materials such as cerium oxide or aluminium oxide are normally used for finishing. For grinding or abrading, it is possible to use nickel bonded diamond pellets on a fabric or plastics base whereas for polishing materials other than glass and for the initial polishing of glass it is possible to use an epoxy bonded diamond sheet in the form of epoxy-diamond pellets. The bonded abrasive material can be applied to the sheet as beads thus providing localised polishing areas with spaces therebetween This helps the removal of the abraded material by allowing it to pass between the beads of bonded abrasive material and provide the required flexibility.

Where a softer abrasive material is required, this can be mounted in a binding material which is designed to breakdown at a sufficient rate to expose fresh-abrasive material so as to be available for the polishing action. It is thus known that an erosion promoting material can be added to the matrix material to be used to bind an abrasive material together in order to ensure that the matrix binding material will erode at a sufficient rate to expose abrasive material. (see for example a paper by B. E. Gillman et al entitled "Bound-Abrasive Polishers for Optical Glass" in Applied Optics vol. 137 No. 16, 1986 pages 3498 to 3505).

In order to provide a better polishing process solid lubricant particles are provided in the matrix as well as the abrasive material. This reduces friction between the matrix material and the glass and stabilises the lubrication of the abrasive action. Such lubricant particles can for example comprise talc particles (magnesium silicate). If such a lubricant is used, the matrix can comprise rubber since the friction between the workpiece e.g. glass and the matrix is reduced.

The sheet 104 must be sufficiently flexible to flex when the membrane 100 is displaced during polishing. Since the sheet 104 is separate from the membrane 100, it must have good torsional strength in order to survive the polishing process without deforming e.g. creasing. During a typical polishing process, a 3 kilogram drag can be experienced by the polishing sheet 100.

Since the sheet 104 has a larger radius of curvature than the membrane 100, during polishing, when the membrane 100 is deformed by pressure on the workpiece, there will need to be some lateral movement between the sheet 104 and the membrane 100. Thus the inner surface of the sheet 104 and/or the surface of the membrane 100 should provide such. This can be provided by applying a material between the membrane 100 and the sheet 104 when the abrasive cup 101 is fitted to the tool head unit. For example, a lubricant can be placed between the sheet 104 and the membrane 100. The use of such a lubricant, however means that the sheet 104 can gain no torsional support from the membrane 100 and will simply slide over it. Instead, a non-curing or unset adhesive can be used which allows lateral movement but provides some adhesive properties between the membrane 100 and the sheet 104. Because of the nature of the unset adhesive, it is also possible to easily remove the abrasive cup from the tool head unit. This avoids the need to retrieve the tool head which would be necessary if the abrasive was bonded directly to the membrane 100 or a slurry was used. Also, the abrasive will wear out and need replacing regularly. Further, different grades of abrasive will be needed for different polishing stages and thus different abrasive cups can easily be interchanged.

The sheet 104 can be formed from a substrate sheet material cut in a form as illustrated in FIG. 10. Holes are cut in the sheet to enable it to be deformed into the curved shape necessary to lie over the membrane 100. The sheet material used can either be a polishing cloth material to which an abrasive slurry must be added, or the sheet can be a sheet having abrasive material bonded thereto. It is also possible to use sheet illustrated in FIG. 10 merely as a substrate onto which can be mounted a working material. FIG. 11 illustrates a shape of such a piece which can be cut and formed on to the sheet 104. Once again the material can either comprise a conventional polishing cloth with which a conventional abrasive slurry must be used, or can be formed of a sheet material having abrasive bonded to or impregnated in the sheet.

A method of forming an abrasive cup will now be described with reference to FIGS. 12 and 13. In the first step S1 the sleeve 109 is arranged around a cylindrical former 111 having a convex end. A sheet of polishing material 110 is arranged over the convex end of the former 111. In step S2 the edges of the sheet of polishing material 110 are adhered to the outer surface of the sleeve 109 and are clamped in place using a clamp 112. Then in step S3 the sheet of polishing material 110 is pressed between the convex face of the former 111 and a concave face of a former 113. In this way the convex shape required for the sheet of polishing material 110 is achieved. Then in step S4 the two formers 111 and 113 are retracted allowing the removal of the abrasive cup.

The abrasive cup can be used for grinding or polishing. Also, the abrasive cup can be used in an intermediate process ductile mode grinding. In this mode the workpiece surface is removed by the cutting action of the bound abrasive particles in the form of fine swarf. This is distinct from the chips produced in fracture mode grinding. Ductile mode grinding gives a better finish with much less subsurface damage. The mode is achieved by the choice of pressure and speed for a given abrasive.

The operation of the polishing apparatus will now be described hereinafter wherein the head assembly is controlled so as to present the head unit (8) at an angle away from normal to the surface of the workpiece.

FIG. 14*a* illustrates the application of the working member unit 8 against the workpiece 5. The cup membrane 110 complies to the surface of the workpiece 5. The dotted line in FIG. 14*b* illustrates the removal profile obtained using the working member 8 based perpendicularly to the workpiece 5 and rotated about its axis. FIG. 15 illustrates the abrasive action of the working member 8 against the workpiece 5. As can be seen because there is zero rotation at the centre of the area of contact the removal rate at the centre is zero. This removal profile is disadvantageous since it is difficult to achieve the desired profiling across the workpiece using such a removal profile. The inventors have thus realised that by tilting the working member 8 at an angle 8 to the normal to the workpiece 5 and moving it to precessed positions, is possible to obtain the removal profile illustrated in the dotted line in FIG. 16. Because there is no stationary region anywhere i.e. The centre of rotation of the membrane 110 is not an the surface of the workpiece, there is no area of zero removal. This removal profile is thus nearer a desirable Gaussian profile.

FIG. 17 illustrates the pressure distribution across the workpiece provided by the soft tool of this embodiment. As can be seen there are no sharp discontinuities in the pressure. It is provided evenly across most of the area of contact and decays slowly at a the edges because of the soft nature of the tool It can be seen in FIG. 14*b* that tilting the axis of rotation of the tool away from normal to the workpiece and precessing it provides a better removal profile. The method of removal comprises an abrasive action as shown in FIG. 19 for no precession, this can lead to scratches or grooves being formed in the workpiece in much the same way as the action of an abrasive belt. In order to avoid any possibility of such scratches or grooves remaining, the polishing action carried out by the polishing machine is not merely the polishing by tilting of the working member a at an angle to the normal to the surface, but includes the polishing of the workpiece at the angle precessed about the normal. This is illustrated in FIG. 18. N indicates the direction normal for the workpiece W, and P indicates the polishing direction i.e. The direction of rotation of the working member. The working member 9 thus rotates about the polishing direction at an angle $\theta$ to the normal N but the polishing direction P also rotates or precesses around the normal N. The result of this is that at each position around the precession a polishing action illustrated in FIG. 15 is carried out at a rotated angle dependent upon the angle of precession. Thus each time the vector P is moved around the normal N by an angle the polishing effect illustrated in FIG. 13 is rotated by that angle. Thus once a complete precession has taken place, the pattern in FIG. 15 has been applied at all angles of rotation. This has the affect of averaging out the pattern of polishing thus reducing the likelihood of any defects being caused by the polishing pattern.

Because the workpiece being polished is generally not flat, the diagram of FIG. 18 is an over-simplification.

FIG. 19 illustrates the practical position wherein the normal to the workpiece surface continually changes dependent Upon the position of the workplace to be polished. Of course, the vertical V to the workpiece defined as the z axis remains constant. Thus the angle of polishing $\theta_2$ is the summation of the precession angle $\rho$ plus the angle $\theta_1$ at which the normal N is to the vertical V. Although in FIG. 19, all the angles are shown in a single plane, of course, these angles are angles in three dimensions.

FIG. 20 is an illustration of the same information projected onto a sphere. V, N and P have the same meanings as in FIG. 19. This diagram defines these three directions in space. When precessing, angle $\gamma$ changes and angle $\rho$ stays constant. Angles $\alpha$ and $\beta$ are the two driven angles in the pivot mechanism which have to be computed from displacements a and b in order to control the pivot mechanism.

The slope of the workpiece's surface at any point will be calculated as described in more detail hereinafter given $\phi_1$ and $\theta_1$. The polishing routine for the particular task will have $\rho$ and $\gamma$ as given data (which may change during the run). To find the driven angles $\alpha$ and $\beta$, it is first necessary to find $\theta_2$ and $\phi_2$ from:

$$\cos\theta_3=\cos\rho\cdot\cos\theta_1+\sin\rho\cdot\sin\theta_1\cdot\cos\gamma \quad (1)$$

$$\sin(\phi_1-\phi_2)=\sin\rho\cdot\sin\gamma/\sin\theta_2 \quad (2)$$

$$\cos(\phi_1-\phi_2)=(\cos(\rho)-\cos(\theta_2)\cdot\cos(\theta_1))/(\sin(\theta_2)\cdot\sin(\theta_2)) \quad (3)$$

The use of equations 2 and 3 enables the solution for $(\phi_1-\phi_2)$ to be placed in the correct angular quadrant.

Having $\theta_2$ and $\phi_2$ we can find the gimbal drive angle $\alpha$ and $\beta$ from:

$$\alpha=\tan^{-1}(\cos\phi_2\cdot\tan\theta_2) \quad (4)$$

$$\beta=\sin^{-1}(\sin\phi_2\cdot\sin\theta_2) \quad (5)$$

The apparent signs of the angles $\alpha$ and $\beta$ will depend on the drive systems of the pivot and will need to be set by inspection.

The usual precautions in computing are necessary to deal with division by zero if occurring in equation 2.

The determination of the slope surface of the workpiece will depend upon the position on the workpiece and the surface shape.

One particular shape that is important in optics is the "even asphere" The "even asphere" is used for a surface which is part of a sphere at the very centre, but with edges which are raised or lowered more than the spherical curve. Such a shape can either be concave or convex.

If in the x, y and z axis, z is the height which increases positively as we move upwards from the plane of the turntable, positive z on a glass workpiece will always correspond to more glass. In accordance x and y are positioned to be horizontal to the plane of the turntable and centred on the axis of the turntable. Thus x, y and z are right handed axis. The formula for the even asphere is a height z as function of x and y:

$$z=c\cdot r^2/(1+A)+a_2\cdot r^2+a_4\cdot r^4+a_6\cdot r^6+a^8\cdot r^8 \ldots \text{ where } r^2=x^2+y^2, \quad (6)$$

$$A=\text{sqrt}(1-(k+1)c^2r^2),$$

and c, k, $a^2$, $a^4$ etc are the constants which define the surface required on a particular workpiece. c is the reciprocal of the radius of curvature of the central sphere. k is referred to as the conic constant, which is defined by this formula. If all of the constants are zero, the surface is flat, and if just c is non zero the surface is a sphere. Various values of k are used for defining parabaloids, ellipsoids and hyperboloids of revolution.

In order to determine the slope or gradient of the curved surface at the contact point of the tool, equation (6) is differentiated. This gives the gradient of the required surface in the radial direction as:

$$dz/dr=c\cdot r/A+2a_2\cdot r+4a_4\cdot r^3+6a_6\cdot r^5+8a_8\cdot r^7 \quad (7)$$

The angles defining the normal line N are thus given as:

$$\theta_1=\text{angle } VP=-\tan^{-1} dz/dr \quad (8)$$

The sloping angle at the contact point is given by:

$$\phi_1=\tan^{-1} y/x \quad (9)$$

where x, y is the contact point. These angles of the surface normal are for any axially symmetrical lens. For asymmetrical lenses its surface equation must be substituted to find $\theta_1$ and $\phi_1$.

The angles $\theta_1$ and $\phi_1$ are computed and used in equations 1 and 2 to give the pivot drive angles for a lens.

So far no consideration has been given to the fact that the pivot point of the pivot arrangement is not at the centre of point of contact on the surface of the workpiece. It is at or near the centre of curvature of the membrane and thus when the pivot arrangement is rotated at any angle $\theta_1$ and $\phi_1$ if no compensation is made for the displacement of the pivot point away from the surface of the workpiece, the head unit would move substantially in any of the x, y and z directions. Thus this embodiment of the present invention avoids this problem by compensating for the shift in x, y and z coordinates generated by rotation in angles $\theta_1$ and $\phi_1$. The compensation can either take place In the form of real time calculations using the equations given hereinafter, or the calculations could be carried out for the angle $\theta_1$ and $\phi_1$ beforehand and stored in a look-up table.

The other point to be taken into account when calculating the position of the centre of the point of contact is the compressibility of the soft tool.

The centre point of the pivot is a distance D from the centre of the tool polishing face when the tool is not compressed. The tool is compressed by a distance d measured in a direction which is normal to the surface of the workpiece.

The coordinates x, y and z find the centre of the tool contact position after compression and tilt with the tool i.e. The centre of the area which has been worked. $\theta_1$, $\phi_1$, $\theta_2$ and $\phi_2$ are the angles of the surface normal and tool spin.

X, Y and Z define the centre of the pivot mechanism.

D is the distance from the centre of the pivot to the uncompressed tool tip.

d is the amount by which the tool surface is compressed e.g. 0.3 mm.

T is the radius of curvature of the spherical tool tip e.g. 30 mm as shown in FIG. 20.

The equations defining the centre of the pivot mechanism are:

$$X=x+(T-d)\cdot\sin\theta_1-\cos\phi_1+(D-T)\cdot\sin\theta_2\cdot\cos\phi_2 \quad (10)$$

$$Y=y+(T-d)\cdot\sin\theta_1\cdot\sin\phi_1+(D-T)\cdot\sin\theta_2\cdot\sin\phi_2 \quad (11)$$

$$Z=z+(T-d)\cdot\cos\theta_1+\cdot(D-T)\cdot\cos\theta_2 \quad (12)$$

Thus, using the equations given hereinabove, the movement of the working member a caused by the precession can be corrected.

As mentioned above, because of the precession, the non-axially symmetric ablation carried out by the tool at an angle Is averaged to a substantially axially symmetric ablation pattern by precession.

The precession operation can be carried out at each polishing location so that the working member 8 is arranged to precess through at least 360 degrees about the normal to the workpiece. However, a more efficient method is to cover a required area of the tool using one precession angle, increment the precession angle, and then polish the area again. This has the same averaging effect but reduces the amount of pivot arrangement movement required and speeds up the polishing process. The required areas can be concentric annuli resulting from the applications of the tool and the rotation of the turntable carrying the workpiece.

In this embodiment the increment of the precession angle around the normal is chosen to be an integer fraction of 360 degrees in order to provide a symmetric distribution of precession angles.

One advantage of using the precession of the soft tool instead of rotating it with an axis normal to the surface of the workpiece as performed in the prior art is that the tool is self wetting. Because of the non-axially symmetric ablation pattern, the fluid e.g. water used for wetting the abrasive material or the abrasive slurry is drawn under the tool by the lateral movement. In contrast, using a conventional rotating tool, the polishing material thereunder tends to be thrown out regularly.

The control of the polishing apparatus by the computer control system 9 will now be described in more detail.

The computer control system 9 controls the x, y and z axis movement, the a and b axes, the spin h of the head 7, the speed of the turntable C, the motor power for rotating the working member 8, and the hydraulic pressure within the tool. It is also possible to control the feed of slurry or the lubricating/cooling fluid. These variables may be controlled to maintain at a desired level the rate of mechanical work (watts) done by the abrasion of the tool against the workpiece. The rate of work is computed from the motor speed and current (which may be monitored by standard methods), and using data provided by the manufacture of the motor, this control of the rate of work enables accurate control of the rate of material removal.

In this embodiment the computer receives no feedback on the x, y and z, a and b coordinates. These are based on dead reckoning. The tool spin speed is measured and the work done by the motor is monitored. The turntable speed can also be controlled. The vertical and lateral load on the tool is measured by the load cells 42.

The program within the computer control system 9 operates an algorithm in order to receive as an input the desired surface form. Also the current surface form of the workpiece 5 is obtained by measurement and thus a form error is determined i.e. determination of the amount of material to be removed across the surface is determined. Also the influence function i.e. The removal rate pattern (as it is modified by the action of precession) of the soft tool is determined and used to determine a pattern of polishing.

The type of abrasive to be used is selected dependent upon the amount of material to be removed, and the type of material. This will determine the pressure to be applied to the workpiece. Using the information on the form error and the pressure required, a contact area for the soft tool over the surface can then be determined. This of course can vary dependent upon the form error pattern. Using the influence function a pattern of removal can then be estimated in order to move from the current workpiece form to the target form. Typically the algorithm will only attempt to reach 80% of the target in order to avoid over shooting i.e. removing too much material. The process can however, iteratively repeat in order to achieve the target form.

The parameters which can be controlled are the dwell time, the contact area, the head rotation speed, the workpiece rotation speed, the pressure on the workpiece, the force on the workpiece and the fluid pressure.

Computation of the required dwell times, in order to achieve the target surface, is carried out using a numerical optimisation process. The dwell times are calculated for the position of the tool in relation to relatively proud features on the surface of the workpiece. The longer the dwell time, the more the proud feature is reduced. The aim of the numerical optimisation is to minimise the "Sum of squares" height remaining after the process.

A given tool operates with given compression and speed, and through a given precession cycle, provides a local "influence function" i.e. a local area of workpiece removal which is characteristic of the tool and the variables in its use. This influence function is measured experimentally. A cross-section of such a function is shown in FIG. 22 from centre to edge. It represents the depth of possible workpiece removal at a fixed position per second. This may also be represented as a map and is illustrated in FIG. 23. For an off-centre part of the optical surface which will in general be sloped in relation to the plane of the x y axis, the influence function appears slightly fore-shortened in projection into that plane as shown in FIG. 24. The contour area is enlarged in FIG. 25.

Referring back to FIG. 22, for a radial figuring pattern, as the workpiece is rotated on the turntable, the local influence function is drawn out into a groove. A series of grooves is possible for different radii on the workpiece and cross-sections of the grooves are shown in FIG. 26, again in units of depths per second. It should be noted that there is less removal on outer parts of the workpiece as the effective removal is distributed all around the workpiece instead of being more concentrated in the centre i.e. The circumference of the circles traced by the head are longer. The actual workpiece (glass) removal is given by the shape of one of the profiles multiplied by the time in which the tool works in that profile (the dwell time). By choosing a dwell time in each groove, various overall shapes for glass removal measured along a radius of the lens may be obtained. For example, a profile of a part made lens surface requiring work is illustrated in FIG. 27. It has a form error defect consisting of an annular raised area, whereas the centre and edge of the lens are at almost the required height. By using a standard least squares algorithm far optimisation, the dwell times required for each radius on the lens, to remove the annular raised areas are computed. This is shown in FIG. 28. By multiplying each groove profile by the corresponding dwell time and adding this computed affect to the profile shown in FIG. 27 a forecast for the resulting profile is obtained as shown in FIG. 29. The area of the surface of the surface which is considered has been affectively flattened and this confirms the correctness of the computation.

In computation of the required dwell time, a feedback process can be used for correcting errors in the glass removal process, such as might be caused by slackness in gears, lack of straightness in the mechanical slides, or changes in general operating conditions such as humidity or temperature.

The feedback process requires the analysis of the actual glass removal after a grinding or polishing run. The result of the analysis is a set of dwell times giving a least square fit for glass removal. The dwell times are retrospective times which the machine would have been expected to use to achieve such a removal. The feedback information is obtained by comparing the notational retrospective values with those which are actually replied. The comparison takes the form of finding the ratio of real to retrospective dwell times. The result of the comparison is a correction. Examples of the corrections are: (1) a constant ratio factor by which the computed dwell times for real glass removal should be increased or decreased to give the required results and (2) a set of such ratios used as correction factors for the dwell times, the set corresponding to a set of different positions on the workpiece.

The determination of correction factors is also important for machine engineering and maintenance purposes since they will indicate defects in operation.

The numerical optimisation process can also determine the desired contact area between the tool and the workpiece.

This is achieved simply by using more than one influence function. A further set of ablation profiles (typically cross-sections of grooves) is obtained for each additional influence function. The result of the numerical optimisation then includes dwell times for each set of ablation profiles. The nature of an optimal result is that if a given profile is not advantageous, then a zero or very small dwell time will be assigned to it. Thus the assignment of significant dwell times to certain ablation profiles selects a tool contact area.

The process of determining dwell times will now be described with reference to flow diagram of FIG. 30. The shape of workpiece surface to be polished is determined by measurement (step S10). Data defining the desired shape is input in step S11 and in step S12 the desired shape data is subtracted from the determined data to obtain shape error data.

The influence function for unit dwell time is then mapped for the predetermined positions in step S13. In this embodiment a separate map is generated for each influence function i.e. a single curve of FIG. 26. Initial dwell times are then input in step S14 to start the optimisation process. The initial dwell times chosen can be any arbitrary initial values such as a unit time for all positions. The mapped influence functions are then multiplied by the input initial dwell times and the maps are added to determine a predicted removal map (step S15). In step S16 the predicted removal map is subtracted from the form error to determine a list of height errors for the predetermined positions. It is these height errors which define the error between the desired shape and the predicted polish shape which is to be minimised by the least squares algorithm. Thus these values are input into the least square algorithm and in step S17 the algorithm attempts to minimise the errors. In step S18 it is determined whether the optimization is finished. If not, in step S20 the algorithm creates a new case set of dwell times and the process returns to step S15 to repeat the minimisation process.

If in step S18 the optimisation process has finished, in step S19 the dwell times determined are translated into velocities for the polishing head for A positions for figuring patterns. Then in step S21 the machine polishes the workpiece used in the determined velocities.

The process can be repeated by returning to step S10 to measure the shape to see if the desired shape is actually be achieved. If not, steps S11 to S21 can be repeated.

While this process has been described hereinabove, in respect of a 2D process, the process is equally applicable to a 3D process for use with a 3D influence function, a 3D desired shape, and a 2D array of predetermined positions for the computation of dwell times thereat.

In the 3d arrangement, there is a far greater control of the polishing since, unlike the 2D arrangement, the same radial positions can be polished differingly. The numerical optimization problem merely becomes one of the determining dwell times for a 2D, rather than a 1D, array of points. If there are potentially a large number of points, thus making the process potentially lengthy, a small array of points can be chosen e.g. by dividing the area into segments and processing separately, or by providing positions over the area which are separated by large gaps. In the latter process, each figuring pattern is unlikely to pass over a sufficient number of closely arranged positions for the determination of dwell times (i.e. The speed of the polishing head along the path). In this case, dwell times or points along the figuring pattern can be determined by a process of interpolation between the predetermined positions.

In the 2D and 3D embodiments described hereinabove, the dwell times used are for static influence functions which define the removal profile at a position for a unit tide. This does not however take into account that instead of the tool head being lifted and placed at each position, the preferred technique is to continuously move the tool head over the surface of the workpiece Thus, there is no position at which the head dwells. The inventors have therefore developed a dynamic dwell time technique. In this technique an influence function is defined as the removal profile for a unit tool head velocity for a particular figuring pattern. This is determined by projecting the static influence function along the figuring pattern at a predetermined (e.g. unit) velocity.

FIGS. 31*a* and 31*b* illustrate two different types of dynamic influence functions mapped onto a surface to be polished. FIG. 31*a* illustrates a rastering figuring pattern, FIG. 31*b* illustrates a circular figuring pattern.

FIG. 31*a* illustrates three dynamic influence functions applied to three positions $P_1$, $P_2$ and $P_3$. It should be noted that the dynamic influence function has the same shape for each position since the figuring pattern 200 is the same at each position i.e. linear.

In FIG. 31*b*, the figuring pattern 201 is circular and thus as can be seen in the diagram the figuring pattern for different radial positions changes shape At the centre position $P_1$ the pattern is circular whilst a radial positions $P_2$ and $P_3$ the dynamic influence function is extended along the figuring path.

This technique will result in the determination of velocity for the tool head at positions (e.g. $P_1$, $P_2$, and $P_3$) across the workpiece surface to be polished. Thus in this embodiment step S19 of FIG. 30 is not required.

It will thus be apparent to a skilled person in the art that because this aspect of the present invention operates to optimise dwell times or tool speeds for positions on the workpiece, a simple process of optimising the values can be used. Any numerical analysis technique can be used to optimise values to achieve a desired result e.g. a desired mean error.

In the present invention at least one cost function can be minimised. The cost functions can includes 1. Height errors
2. Gradient errors
3 Total polishing time
4. Excess of tool speed over a limit The cost functions can be appropriately weighted.

For numerical analysis the cost functions are appended series of numbers to be optimised by the algorithm.

So far in the embodiments, only the removal of material in order to achieve the desired shape has been considered. However, polishing requires not only the required shape but also the required surface roughness (micro-roughness).

An optical or other polished surface can have quality failings in terms of micro-roughness, as well as the more obvious large-scale form errors. Micro-roughness is a property of the surface often conventionally expressed as the average local height departure from a well-smoothed surface and denoted as Roughness Average "Ra". The present invention can provide a roughness-reduction method by the appropriate operation of the precessed tool.

Micro-roughness is measured with equipment such as interferometers operated through microscopes (for example, the proprietary WYKO NT 2000 interferometer) or with contact methods (for example, the proprietary Taylor Hobson Talysurf). The roughness at various stages in the polishing process may be measured at different stages of production for the first workpiece in a production run of similar workpieces, and thenceforth may be considered well enough known during the process.

In the method of this embodiment there are alternative criteria for commencing roughness-reduction. It is commenced if measurement shows that the form of the workpiece is already within acceptable limits apart from its roughness quality. A typical case is that the form is correct within a customer's requirement of 100 nanometres peak-to-valley form error, but parts of the surface exhibit Ra values of 10 nanometres or more, whilst a finished quality of Ra less than 3 nanometres is required. It is also economic to commence roughness reduction it measurement shows that the less than a further 100 nanometres of workpiece material (usually glass) has to be removed to meet the specified form of the surface within tolerances. if this small amount of material were removed without the roughness-reduction technique, that technique could still need to be applied is before the product was acceptable.

The removal rate of the polishing process is determined by experiments in which small areas are polished, and the depth of ablation is measured by interferometry. it is advisable for this removal rate to be validated by its successful use in the process of roughness-reduction, according to he method disclosed here.

Roughness reduction is achieved by polishing the surface with a set of short dwell times, corresponding to small removals. The dwell times are chosen such that each of a set of precession positions (usually four at 90 degrees) removes a depth of material which is less than or equal to four times the current value of Ra, the preferred value being one to two times Ra. As this removal takes place, existing rough features on the polished surface are ablated as new ones are formed.

By removing a depth of one to two times Ra, the new rough feature are much less significant than the previous features. This is illustrated in FIGS. 32 and 33. FIG. 32 shows a rough surface profile, indicating a schematic value of Ra, and indicating that the initial effect of further ablation is to remove peaks. FIG. 33 shows the Ra value of roughness on a surface and how it changes with continued ablation. In FIG. 33, the line falling to the right indicates the removal of preexisting roughness features: the line rising to the right indicates the formation of new roughness features. The new roughness feature rise very slowly at first, as the initial ablation merely removes pre-existing peaks, rather than creating new features. As the new and old roughness features have a random character, the sum of old-plus-new feature is the root sum of squares. This is indicated by the dotted curve. An optimum removal occurs at the minimum of the curve indicated by A in FIG. 33.

In practice it is advisable to operate the process cautiously, as unexpected features appear in the polished surface, for example, due to accidental agglomerations of polishing particles. Cautious operation consists in attempting to remove one to two times Ra, preferably the lower figure. However, it can be economic to remove four times Ra in the initial stages of the process if the micro-roughness is not well determined owing to the presence of small scratches.

The use of the precession method in these processes causes striations caused by continual rubbing in one direction to cross those in previous passes rather than simply being deepened. After using a set of passes with rubbing directions at 90-degree intervals, it is a refinement in the next step of passes to use the four intermediate rubbing directions at 45 degrees to the first set.

Although the present intention has been described hereinabove with reference to a specific embodiment which uses a soft tool in the form of a bulbous compliant member which is precessed at an angle to the normal of the workpiece, an aspect of the present invention is not limited to this and any form of tool can be used which generates relative lateral movement between the abrading surface and the workpiece in a direction which can be rotated on the workpiece.

FIG. 34 illustrates an alternative working member for use in the head 7 to grind material from the workpiece. This can be used when mass removal of material is required to form the workpiece surface shape before polishing can begin. This working member is not compliant.

As illustrated in FIG. 34, the working member is arranged to fit over the tool head 38 of the embodiment of FIG. 4. The tool housing 6B is modified slightly at its upper region to include an outer threaded portion to receive an outer housing 200 of a grinding tool. The outer housing 200 is cylindrical and is mounted to the tool housing 68 at an upper end thereof. At a lower end thereof the housing 200 is provided with a plate 201. The plate 201 is clamped to the housing 200 via screws 202 and clamps therebetween a spoked flexible member 203 of similar shape to the spoked member 58 illustrated in FIG. 6. The spoked flexible member 203 is clamped at an outer annulus between the plate 201 of the housing 200.

Within the housing 200 there is provided a piston member 204 which is capable of relative vertical movement within the outer housing 200. The piston member 204 has an upper cylindrical portion which extends around a bush 205 to provide guidance for the vertical movement. The bush 205 rides on an outer surface of the tool housing 68. A lower end of the piston member 204 has a concave surface to receive the membrane 69. In this way the membrane 69 can act on the piston member 204 to drive the piston member 204 axially up and down. The piston member 204 is supported by an inner annulus of the spoked flexible member 203. The inner annulus of the spoked flexible member 203 is provided around a spigot 206 of the piston member 204 and clamped onto the piston member 204 by a nut 207 threaded on the spigot 206 The spigot 206 is arranged to extend through the plate 201. A dome shape grinding member 208 is arranged to be carried on the spigot 206 and locked in place thereby by a nut 209 and washer 210. Thus in this way the dome shape grinding member 208 can be driven up and down by the piston member 204.

Thus this embodiment to the present invention provides a dome shape grinding member 208 which is not compliant but which can be held on the head 7 at an inclined angle and precessed about a precession access vertical to the workpiece surface being ground. The action of the membrane 69 and the piston member 204 act to provide pressure control on the dome shape grinding member 208 to thereby allow the control of pressure applied during the grinding action.

Although the embodiments have been described with bulbous compliant tools, for a convex surface of a workpiece a flat or concave compliant tool could be used and is within the scope of the present invention.

The embodiment is described as having a fully hydraulic pressure applying system. However, the present invention also encompasses a fluid filled tool head with a mechanical pressure transmitting coupling in the tool body.

Features of the aspects of the present invention can be used in any combination.

Since the present invention includes the computer control of a polishing machine, the present invention can be embodied as a computer program for controlling the machine. Thus the present invention includes a carrier medium which includes storage media such as floppy disks, CD ROMS, programmable read only memory devices and magnetic tapes, and electrical signals carrying the computer program, over a network such as the Internet.

Although the present invention has been described hereinabove with reference to specific embodiments, it will be apparent to a skilled person in the art that the present invention is not limited to the specific embodiments and modifications can be made within the spirit and scope of the invention.

What is claimed is:

1. A machine for abrading a workpiece, the machine comprising:

a holding surface for holding said workpiece;

a head member arranged along a rotation axis to rotate about the rotation axis;

a working member having a surface for abrading said workpiece arranged on said head member on said rotation axis for rotation about said rotation axis with said head member;

first driving means for driving said head member and said working member mounted thereon to rotate about said rotation axis;

head mounting means for mounting said head member;

second driving means for driving said head mounting means to incline said rotation axis of said head member relative to a precession axis intersecting said rotation axis, and for moving said head member to inclined positions with said rotation axis precessed about said precession axis; and third driving means for relatively moving said head mounting means across said holding surface.

2. A machine according to claim 1 wherein said first driving means is arranged to drive surface of said working member in a lateral direction relative to said holding surface, and said second driving means is adapted to rotate said surface of said working member relative to a position on said holding surface so that a direction of lateral relative movement of said surface of said working member and said holding surface rotate relative to said position on said holding surface.

3. A machine according to claim 1, wherein said second driving means is arranged to move said head member to inclined positions distributed through an integer number of 3600 of precession of said rotation axis about said precession axis.

4. A machine according to claim 1, wherein said second driving means is arranged to move said head member in precession steps.

5. A machine according to claim 4, wherein said second driving means is arranged to move said head member in precession steps which are symmetrically distributed-about the precession axis through an integer number of 3600 of angle of precession about the precession axis.

6. A machine according to claim 1, wherein second driving means is arranged to incrementally carry out the precession at precession steps which are not integer division of 360 degrees.

7. A machine according to claim 1, wherein said head mounting means is arranged such that said precession axis intersects said rotation axis at or near said abrasive member.

8. A machine according to claim 1, including control means for controlling said first and second driving means such that the rate of movement of said head member about said rotation axis is substantially smaller that the rate of rotation of said head member.

9. A machine according to claim 1, wherein said head mounting means includes first and second arcuate members arranged orthogonally, each with a center of curvature arranged to lie on an axis passing through or near said working member, said head member being mounted at a second end thereof to said first and second arcuate members by said second driving means to move said second end of said head member in a respective orthogonal arc about a respective axis of the arcuate members.

10. A machine according to claim 1, wherein said third driving means is arranged to also relatively move said head member to and away from said holding surface.

11. A machine according to claim 1, wherein said holding surface is arranged to be relatively rotated with respect to said head mounting means.

12. A machine according to claim 1, wherein said working member is bulbous.

13. A machine according to claim 12, wherein said working member is compliant.

14. A machine according to claim 1, including control means operative to receive information on the topography of said workpiece and to control said second driving means to precess said head member about said precession axis normal to the surface of said workpiece at a position being abraded or polished.

15. A machine according to claim 14, wherein said control means is operative to receive information on the roughness of said workpiece and a rate of removal for material removed from said workpiece by said working member, to control said third driving means to move said head mounting means in a repeated figuring pattern and to control said first, second and third driving means to remove less than four times a local roughness average for a region of the workpiece being polished or abraded during each configuring pattern.

16. A machine according to claim 15, wherein said control means is adapted to control said second driving means to use varied inclined positions about said precession axis for each figuring pattern.

17. A machine for abrading a workpiece, the machine comprising:

a holding surface for holding said workpiece;

a head carrying a face for abrading said workpiece;

a mounting arrangement for supporting and moving said head across, to and from said holding surface;

a tilting mechanism mounted on said mounting arrangement and arranged to tilt said head about a pivot to an angle relative to said holding surface; and control means for controlling the position and tilt of said face of said head by controlling said mounting arrangement and said tilting mechanism, said control means being operative to compensate for movement of said face when tilted by controlling said mounting arrangement.

18. A machine according to claim 17, wherein said control means is operative to perform the compensating control by calculating the change in position of said face caused by the tilt.

19. A machine according to claim 17, wherein said control means is operative to perform the compensating control by looking-up the change in position of said face caused by the tilt.

20. A carrier medium storing instructions for controlling a processor to control a machine according to any one of claims 1 to 16 or 17 to 19.

21. A machine for abrading a workpiece, the machine comprising:

a housing extending along a rotation axis and having a housing fluid pressure transmission membrane at one end of said housing, said housing being rotatable about said rotation axis;

a head releasably mounted on said end of said housing, said head comprising a head housing, a head fluid pressure transmission membrane, and a resilient membrane forming a sealed head fluid chamber filled with fluid, said head fluid pressure transmission membrane being arranged in said head housing to cooperate with said housing fluid pressure transmission membrane to transmit pressure to said head fluid chamber, and said resilient membrane being held at a periphery thereof by said head housing to extend bulbously therefrom for the application of pressure to said workpiece during abrading.

22. A machine according to claim 21, wherein said housing has a housing fluid chamber filled with fluid terminating at said housing fluid pressure transmission membrane.

23. A machine according to claim 22, wherein said housing fluid pressure transmission membrane and said head fluid pressure transmission membrane are respective displacement devices mounted respectively in said housing and said head, and are coupled to one another when said head is mounted to said body.

24. A machine according to claim 22, wherein said body fluid chamber and said head fluid chamber are filled with incompressible fluid.

25. A machine according to claim 22, including fluid pressure control means comprising a passage from said body fluid chamber, to a fluid pressure control arrangement provided separate to said rotatable body.

26. A machine according to claim 21, wherein said head is axially mountable to said body.

27. A tool head for releasably mounting on a housing of a machine for abrading a workpiece, the housing having a housing fluid pressure transmission membrane, the tool head comprising:

a head housing, a head fluid pressure transmission membrane and a resilient membrane forming a sealed head fluid chamber for holding fluid, said head fluid pressure transmission membrane being arranged in said head housing to allow the coupling of fluid pressure in said head fluid chamber from said housing fluid pressure transmission membrane, and said resilient membrane being held at a periphery thereof by said head housing to extend bulbously therefrom for the application of pressure to said workpiece during abrading.

28. A tool head according to claim 27, wherein said head fluid pressure transmission membrane is a first displacement device that is coupled with said housing fluid pressure transmission membrane, wherein said housing fluid pressure transmission membrane is a second displacement device when said tool head is mounted on said housing.

29. A tool head according to claim 27, wherein said head fluid chamber is filled with incompressible fluid.

* * * * *